US005891600A

United States Patent [19]

Okuno et al.

[11] Patent Number: 5,891,600

[45] Date of Patent: Apr. 6, 1999

[54] MONO-COMPONENT DEVELOPER, METHOD OF FORMING IMAGE AND METHOD OF FORMING MULTI-COLOR IMAGE

[75] Inventors: Hiroyoshi Okuno; Etsuo Tominaga; Toyofumi Inoue; Tetsu Torigoe; Hiroe Okuyama; Takahisa Fujii; Koutarou Yoshihara; Masahiro Uchida; Hiroshi Nakazawa; Chiaki Suzuki; Yoshifumi Iida, all of Minami-Ashigara, Japan

[73] Assignee: Fuji Xerox Co., Ltd., Tokyo, Japan

[21] Appl. No.: 947,867

[22] Filed: Oct. 9, 1997

[30] Foreign Application Priority Data

| | | | |
|---|---|---|---|
| Oct. 14, 1996 | [JP] | Japan | 8-271201 |
| Oct. 14, 1996 | [JP] | Japan | 8-271202 |
| Oct. 18, 1996 | [JP] | Japan | 8-276126 |

[51] Int. Cl.[6] ..... G03G 9/097

[52] U.S. Cl. ..... 430/110; 430/126; 430/903

[58] Field of Search ..... 430/106, 109, 430/110, 126, 903

[56] References Cited

U.S. PATENT DOCUMENTS

| | | | |
|---|---|---|---|
| 5,429,902 | 7/1995 | Saito et al. | 430/110 |
| 5,447,815 | 9/1995 | Kato et al. | 430/110 |
| 5,637,432 | 6/1997 | Olcado et al. | 430/110 |
| 5,698,357 | 12/1997 | Inoue et al. | 430/110 |

FOREIGN PATENT DOCUMENTS

| | | |
|---|---|---|
| A-46-5782 | 12/1971 | Japan . |
| A-48-47345 | 7/1973 | Japan . |
| A-48-47346 | 7/1973 | Japan . |
| A-58-216252 | 12/1983 | Japan . |
| A-59-34539 | 2/1984 | Japan . |
| A-59-198470 | 11/1984 | Japan . |
| A-59-231550 | 12/1984 | Japan . |
| A-60-123862 | 7/1985 | Japan . |
| A-60-136755 | 7/1985 | Japan . |
| A-60-238847 | 11/1985 | Japan . |
| A-61-249059 | 11/1986 | Japan . |
| A-61-277964 | 12/1986 | Japan . |
| A-63-149669 | 6/1988 | Japan . |
| A-64-73354 | 3/1989 | Japan . |
| A-1-237561 | 9/1989 | Japan . |
| A-2-66564 | 3/1990 | Japan . |
| A-2-97967 | 4/1990 | Japan . |
| A-2-123385 | 5/1990 | Japan . |
| A-4-214568 | 8/1992 | Japan . |
| A-5-72797 | 3/1993 | Japan . |
| 5-188633 | 7/1993 | Japan . |
| A-5-204183 | 8/1993 | Japan . |
| A-6-51561 | 2/1994 | Japan . |
| A-6-102699 | 4/1994 | Japan . |
| A-6-95429 | 4/1994 | Japan . |
| A-6-208242 | 7/1994 | Japan . |
| A-6-250442 | 9/1994 | Japan . |
| A-6-266156 | 9/1994 | Japan . |
| A-8-6286 | 1/1996 | Japan . |
| A-8-269359 | 10/1996 | Japan . |

*Primary Examiner*—John Goodrow
*Attorney, Agent, or Firm*—Oliff & Berridge, PLC

[57] ABSTRACT

The present invention provides a mono-component developer comprising toner particles containing a binding resin, a colorant and an additive and a method of forming images by use thereof. In the present invention said additive is preferably a titanium compound prepared by through the reaction between $TiO(OH)_2$ and a silane compound or through the reaction between $TiO(OH)_2$ and a silicone oil. The specific gravity of the said titanium compound is in the range of 2.8 to 3.6. The average particle diameter thereof is in the range of 10 to 70 nm. The said toner particle is preferably a non-magnetic particle. By making use of the mono-component developer and the method for forming an image using it, charging of the toner, and carriage of the toner can be stabilized over a long period of time, and stable image formation can be obtained.

17 Claims, 3 Drawing Sheets

MONO-COMPONENT DEVELOPER, METHOD OF FORMING IMAGE AND METHOD OF FORMING MULTI-COLOR IMAGE

BACKGROUND OF THE INVENTION

1. Field of the Invention

This invention is related to a mono-component developer and a method for forming an image, more particularly, it is related to a mono-component developer and a method for forming a (multicolor) image comprising the steps of: forming a thin layer of the developer on a developer-holding member by making use of said mono-component developer, carrying said thin layer to a developing region, and developing an electrostatic latent image on a latent image-holding member.

2. Description of the Related Art

In recent years, an electrophotographic dry developing process has been used in not only an electrostatic copying apparatus, but also in a printer, facsimile and copying apparatus as well as combined apparatus of copying apparatus with facsimile. It has been recently required that these apparatuses are formed in lighter and smaller sizes and satisfy ecological requirements such as economy in energy, recycling, etc. In order to satisfy these requirements, an improvement and development have been extended in a method of forming an image and developer used therefore. As a dry development process in an electrostatic copying system practically used at the present are known two kinds of development, one is two component development making use of toner and carrier such as iron powder etc. and the other is mono-component development which dose not use a carrier.

The two-component development is the most widely utilized process. This process, however, suffers from the defect that it can not maintain long term image quality because of deterioration of developer. The toner particles adhere to the surface of the carrier. This process also has a disadvantage in that large developing apparatus is necessary, since it requires a control system for toner concentration to keep the concentration of the toner in the developer constant and a mixing apparatus for mixing the newly added toner with the developer. Therefore, the demand for a mono-component development system which is able to make the developing apparatus light and small has increased.

The mono-component toner development system is classified into two types of processes, one is a magnetic mono-component development system using magnetic toner, and the other is a non-magnetic mono-component development system using non-magnetic toner. In the magnetic mono-component development system, the magnetic toner is retained by making use of a developer-holding member such as a magnet etc. equipped with a means for generating a magnetic field therein and development is carried out. The magnetic mono-component development possesses several advantages that the toner may be easily carried and controlled and internal adhesion of copying apparatus, printer, etc. is minimal. However, the magnetic toner used in the magnetic mono-component development suffers from a serious disadvantage in that it cannot be full-colored because it contains black or brown magnetite and the like therein. Further, there are limits to how much the magnetic mono-component developing apparatus can be reduced in size because the developing roll must include a magnet therein, and therefore, a developing roll of a certain size is required.

On the other hand, colorization may be feasible in a non-magnetic mono-component development system because a magnetic substance is not used in the toner. And since no magnet is used in the developer-holding member, reductions in weight and size, cost-saving, etc. are feasible. In recent years, the non-magnetic mono-component development system has been, accordingly, undertaken to be practically utilized as a small-sized full-color printer.

However, in the non-magnetic mono-component development system, the toner must be supplied and held stably on the developer-holding member and charged and developed by means of only static electric force due to the absence of stable charging and carrying means. While, the two-component development system contains a stable charging and carrying material as carrier, the magnetic mono-component development system has a magnetic force of a magnetic roll as stable charging and carrying means. Therefore, the non-magnetic mono-component development system is significantly inferior to the two-component development system or magnetic mono-component development system in maintaining high image quality over a long period of time. Particularly, in full-color copying apparatus and/or printers using four color developments of yellow, magenta, cyan and black, accurate control of developing amount is required and the toner should have strict performances such as speedy and uniform charge, good fluidity, etc. in order to cope with the miniaturization/speeding up of recent years.

In recent years, instead of corona discharge a method for applying voltage to the surface of a photosensitive material in contact with a charging material directly or via a recording material or while pressing the surface of said photosensitive material directly by the charging material or via the recording material to charge and transfer in direct as a means for charging uniformly the surface of the photosensitive material (electrostatic charged image-holding member) or for transferring a toner image on said photosensitive material as described in, for example, Japanese Patent Application Laid-Open (JP-A) Nos. 63-149669 and 02-123385 has been growing in popularity. The method for charging and transferring is superior to conventional corona discharge, since no ozone is produced and environmental resistance properties are excellent. In this method, the shear in transfer is reduced, since the surface of the photosensitive sheet holding an image is in contact with a transfer sheet(paper). Furthermore, the mono-component developing apparatus, especially the non-magnetic mono-component developing apparatus has the advantage of adapting well to shortening of the path for carrying the transfer sheet and to reduction of the diameter of the photosensitive material which result from miniaturization of image-forming apparatus required by the mono-component developing apparatus or non-magnetic mono-component developing apparatus.

However, this apparatus also has disadvantages. The transfer apparatus must have pressurization to a certain extent during the transfer step. The toner image formed on the electrostatic latent image-holding member is also effected by this pressurization and agglomeration tends to occur, so that a phenomenon of inhibition of migration of the toner to transfer material is seen. This phenomenon is particularly significant in a linear portion in the range of 0.1 to 2.5 mm. The inventors of the present invention inferred that a good deal of toner is applied to the liner portion due to the edge effect and that agglomeration occurs through pressure. The toner image (transfer image) formed at this time has the serious defect of being formed only in profile, the so called "hollow character". In this way, the mono-component developing apparatus, especially the non-magnetic mono-component developing apparatus requires a toner exhibiting prevention of "hollow character".

In order to stabilize the charging and carriage of the toner, a charge controlling agent is conventionally added. Typical examples of negative charge controlling agents may include metal-containing azo dyes, and metal-containing salicylic acid compounds. Typical examples of positive charge controlling agent may include quaternary ammonium salts etc. An addition of such charge controlling agents is effective and indispensable in the maintenance of speedy and uniform charging of toner over a long period of time. However, such charge controlling agents may fail to exert fully their effects due to the presence of additives used in combination therewith, especially externally supplied additives of fine particles for imparting fluidity.

For example, inorganic fine powders like, for example, silica etc. are added to toners. However, this method can not make the carriage of the toner to the developer-holding member and chargeability of the toner optimum at either high temperature and high humidity or at low temperature and low humidity, and has disadvantages in that poor reproducibility of image density, background fogging, dripping of the toner, and internal adhesion of the apparatus, etc. occur.

In order to reduce such disadvantages, use of surface treated inorganic fine powder has been proposed. For example, in JP-A Nos. 46-5782, 48-47345, 48-47346, 59-34539, 59-198470, 59-231550, etc. is described a hydrophobic treatment of silica fine particles. However, these inorganic fine particles can not exert satisfactory effects, especially in chargeability. In the case of using a polyester resin as the binding resin, absolutely no effect was obtained. Further, the above problem of the hollow character occurred in the contact-transfer system.

A method for treating the surface of the inorganic fine particle with silicone oil is proposed as described in, for example, JP-A Nos. 61-249059, 61-277964, etc. as a method for increasing the hydrophobic nature of the inorganic fine particle. It is known that a significant effect can be obtained through this method because of the low surface tension peculiar to silicone oil and because of the lowering of non-electrostatic adhesion between toners, and especially because of the lowering of toner agglomeration under pressure.

However, this conventional method exerts significant effects on the hollow character, but dose not solve the above problem of chargeability (environmental dependency). As a method of relaxation of the negative chargeability of the toner particles, a method of external addition of silica fine particles surface-treated with an amino-denatured silicone oil (JP-A No. 64-73354) and a method of external addition of silica fine particles surface-treated with aminosilane and/or amino-denatured silicone oil have been proposed (JP-A No. 1-237561). These methods could not, however, solve the environmental dependency problem.

Further, the non-magnetic mono-component toner should, as above described, supply and hold stably the toner on the developer-holding member by only electrostatic force and should be charged and developed. Therefore, the non-magnetic mono-component toner must be charged by friction of contact with the developer-holding member (sleeve) and the charging blade for a short time and in a small space. Therefore, the toner must be charged quickly. However, the toner to which the silica fine particles are externally added can not usually be charged quickly with edge, whether with a two-component toner or a magnetic mono-component toner. The non-magnetic mono-component toner has the disadvantages of reverse pole fogging and toner clouding (internal adhesion of the apparatus) tending to occur easily at the low temperature and low humidity at which high charge can be obtained.

As above stated, even if the silica fine particles are subjected to hydrophobic treatment, treatment for relaxation of negative chargeability, etc. the environmental dependency of the charge, charging speed and lack of charge distribution can not be improved with only the silica fine particles.

Titania can be chosen as an inorganic oxide added for the purposes of charge and fluidity. The titania usually used can be charged more quickly than silica and may presumably make the charging distribution sharp through its low resistance. However, in case where titania is added high charge can not be given to the toner and a lowering of the amount carried, lowering of reproducibility of density caused by a lowering of charge and fogging of background tend to occur more easily.

In order to improve this chargeability, whether in two-component or mono-component systems, is proposed a method for externally adding to the toner a hydrophobic titanium oxide obtained by treating the surface thereof with a silane compound, a silane coupling agent, and a silicone oil, etc. (JP-A Nos. 58-216252, 60-123862, 60-238847). Using this conventional method, the charging level of mono-component toner can be improved to a certain extent depending on the types and amounts of treating agents used. Particularly when a treatment is carried out with silicone oil, no phenomenon of hollow character occurs in the contact-transfer system. However, neither charging level nor environmental dependency can be improved satisfactorily.

Improvements in charging level and environmental dependency can be seen by increasing the hydrophobic property of the titanium oxide with a processing agent. However, this titanium oxide is significantly inferior to conventional titanium oxide with regard to its charging speed, sharpness of charging distribution, etc. after the hydrophobic treatment.

The crystals of titanium oxide can be obtained by sulfuric acid method or hydrochloric acid method from an ilmenite-ore. However, when using these methods, chemical bonds formed by dehydration-condensation are naturally present in the crystal obtained. It was not easy to redisperse such agglomerated particles. Using conventional techniques this is because the derived titanium oxide forms secondary and tertiary agglomerations. The fluidity increasing effect of the toner was also significantly inferior to that of silica. On the other hand, the titanium oxide conventionally used has a specific gravity larger than that of silica and has a disadvantage in that it can not tightly adhere to the surface of the toner. It is easily removed from the surface of the toner. Therefore, the titanium oxide is inferior to silica with regard to the charge stability over a long period of time resulting from sleeve adhesion. Titanium oxide also tends to cause adhesion of photosensitive bodies, and thus deterioration of and defects in image quality.

In order to achieve compatibility of fluidity improvement with environmental dependency of charging is attempted an addition of hydrophobic titanium oxide in combination with hydrophobic silica (JP-A No. 60-136755). While the defects of each hydrophobic titanium oxide and hydrophobic silica may be temporarily depressed by this method, they are much more subject to the influence of the other additive depending upon the state of dispersion. It is difficult to control stably the defects of each hydrophobic titanium oxide and hydrophobic silica over a long period of time.

A method is proposed for adding hydrophobic amorphous titanium oxide obtained by hydrolysis to the toner (JP-A Nos. 5-204183 and 5-72797). However, while titanium oxide can improve both charging performance and fluidity of toner, much water is absorbed and contained in the particles, which remains in the photosensitive material at the time of transfer. That is to say, since adhesion between the amorphous titanium oxide and the photosensitive material is strong, only the amorphous remains on the photosensitive material without being transferred. This causes white spots on images or the photosensitive material is damaged by hard titanium oxide at the time of cleaning.

On the other hand, in a method for purifying the titanium oxide by wet process, a method is proposed for hydrolyzing a silane compound in an aqueous medium, treating the surface of the titanium oxide, taking out the titanium oxide in a state of depressed agglomeration and adding the titanium oxide thus obtained to the toner (JP-A No. 5-188633).

The titanium oxide obtained by this method can improve the fluidity of the toner more than the titanium oxide obtained by conventional hydrophobic process can, however, it does not satisfy high negative chargeability and environmental dependency. It also adversely affects the charging speed (admixing property of additional toner) and charging distribution.

When these inorganic oxides are added to the surface of the toner, a filming or fusing of toner to the layer forming material occurs because of the stress applied to the toner from the layer forming material etc. by continuous use over a long period of time, or a change in the toner chargeability occurs by removal or embedding of additives externally supplied. Thus, this conventional method can not maintain stable charging and carriage of the toner over a long period of time easily. In order to solve these problem, is proposed a use of a specific binding resin for prevention of embedding of the additives externally supplied in, for example, JP-A Nos. 6-95429, 6-102699, 6-266156, etc. And a use of specific charging-controlling agent and external additives is proposed in JP-A Nos. 6-51561, 6-208242, 6-250442, etc. However, these methods do not exert sufficient effects. Particularly, in a full-color development system in which four colors are superinposed upon each other, the amount of developing toner development must be controlled very accurately. Therefore, there still remain unsolved problems with regard to the charging amount and long term-stabilization of carriage amount of the toner.

At present, the methods for forming an image adopted in a full-color copying apparatus or printer making use of electrophotographic systems, are exemplified by a-1) a system in which four developing apparatuses are arranged around the photosensitive material and steps of charging, exposure and development are repeated with respect to each toner in four cycles, and a-2) a system in which the charging, exposure and development of four color toner are carried out in one cycle, as well as a-3) a system in which four apparatuses of each charging apparatus, exposure apparatus, developing apparatus and transfer apparatus are disposed in one single apparatus and the toner images are superimposed.

As the system in which four color toners are superinposed are exemplified by b-1) a system in which a toner image formed on the photosensitive material is transferred and superimposed color by color onto a transfer drum around which transfer paper is wound, b-2) a system in which a toner image formed on the photosensitive material are transferred to an intermediate transfer sheet, and color toner images are superimposed on to the transfer sheet and then transferred collectively to the transfer sheet, and b-3) a system in which color toner images are superinposed on to the photosensitive material, and then transferred collectively to the transfer sheet.

While these methods have advantages and disadvantages in printing speed, apparatus size, etc., they are at present utilized according to the objects of the users.

The above systems b-2) and b-3) have the following advantages; (1) system b-2) has good transfer paper carrying properties; and (2) system b-3) is capable of being reduced in size because use of an intermediate sheet is unnecessary. However, these two methods have the disadvantage that transfer of toner images formed on the bottom layer of the transfer paper is difficult because the toner images ultimately transferred to the transfer paper become multilayered.

The full-color development has problems in common that the chargeability of the toner varies over repeated use, and thus the tone of the image changes. However, there has been no method for forming multicolor images able to simultaneously satisfy the problems.

In order to improve the transferring property of the above superimposed toner image in addition to stabilizing the above charging amount, it is necessary that a reduction in adhesion between the toner and the photosensitive material and a reduction in adhesion between the toner and intermediate transfer sheet are made.

SUMMARY OF THE INVENTION

The object of the present invention is to solve the above problems.

The object of the present invention is to provide a mono-component developer having stabilized charging and carriage of the toner over a long period of time and giving a stabilized image density.

Further, the object of the present invention is to provide a mono-component developer which demonstrates few defects such as low developing property, fogging, etc., when employed over a long period of time.

Further, the object of the present invention is to provide a mono-component developer which demonstrates few defects such as filming, fusing, etc., over a long period of time.

The present invention achieves these objects through a non-magnetic mono-component developer.

Further, the object of the present invention is to provide a method for forming an image by making use of the above mono-component developer. Particularly, the object of the present invention is to provide a method for forming an image which causes few problems involving hollow character, wherein the means of transferring toner images of the photosensitive material is not corona discharge, but the application of voltage to the surface of the photosensitive material to transfer while being in contact with the photosensitive material with a charging material in direct contact or through the recording material or while pressing the photosensitive material by the charging material in direct contact or through the recording material.

The inventors of the present invention discovered the fact that a stabilized image with few problems such as change in density, fogging, filming, etc., can be obtained over a long period of time by using a mono-component developer comprising toner particles containing a binding resin, and a colorant and optionally a charge controlling agent and an additive, wherein said additive is a titanium compound obtained by a reaction of $TiO(OH)_2$ with silicone oil or a reaction of $TiO(OH)_2$ with a silane compound. The mono-component developer may be preferably a non-magnetic mono-component developer. And the charge controlling agent may preferably contain a salicylic acid metal complex compound.

The inventors of the present invention discovered also the fact that a method for forming an image comprising a step of forming a latent image on the latent image-holding member, a step of developing the said latent image by making use of the developer on the developer-holding member, and a step of transferring the toner image on the transfer sheet, wherein said developer is a mono-component developer, especially a method for forming an image by making use of contact-transfer system can provide an excellent image without hollow character.

Since the mono-component developer, especially non-magnetic mono-component developer of the present invention fulfills all of the performances required of the mono-component developer such as chargeability, charging speed, low environmental dependency, charging distribution, ability to maintain the charge of the toner on the developer-holding member, low internal adhesion of the sleeve, few flaws and low adhesion of photosensitive material, etc., excellent image quality showing little change in image density, low developing property, low fogging, and defects in image quality, etc. over long periods of time can be obtained. Further, the mono-component developer of the present invention can provide an excellent image quality free of hollow character.

Further, the object of another aspect of the present invention is to provide a method for forming a multicolor image, which is able to transfer accurately a superimposed toner image on a paper.

And further, the object of another aspect of the present invention is to provide a method for forming a multicolor image, which is able to stabilize the toner charge over a long period of time and to provide stabilized image density.

The inventors of the present invention discovered the fact that a stabilized image without defects such as change in image density, fogging, etc., can be obtained over a long period of time and a transferring property for transferring a superimposed toner image on a transfer sheet can be improved by using a method for forming an image comprising a step for developing repeatedly a latent image formed on the latent image-holding member by making use of plural developers and a step for transferring a multicolor toner image superimposed on said latent image-holding member or intermediate transfer sheet collectively on a transfer sheet, wherein said developer is a developer comprising at least a toner particle containing a binding resin and a colorant and an additive, and said additive being a titanium compound obtained through a reaction of $TiO(OH)_2$ with a silane compound or a reaction of $TiO(OH)_2$ with silicone oil, and silica having a BET specific surface area of between 20 and 100 $m^2/g$.

Since the method for forming a multicolor image according to another aspect of the present invention satisfies all of the characteristics required for a multicolor forming process such as the transferring property of superimposed toner images, chargeability, charging speed, low environmental dependency, low adhesion of photosensitive material, etc., an excellent image can be obtained which demonstrates little change in image density over a long period of time, low developing property, fogging, and few defects in image quality, etc.

BRIEF DESCRIPTION OF THE DRAWINGS

In FIG. 1, 101 is a latent image-holding member, 102 is a roller charging device, 103 is a developer-holding member, 104 is a developer-supplying roller, 105 is a layer forming blade, 106 is a roller transfer apparatus and 107 is a blade-type cleaner.

In FIG. 2, 201 is a latent image-holding member, 202 is a developer-holding member, 203 is a roller charging device, 204 is a developer supplying roller, 205 is a layer forming blade, 206 is a transfer drum, 207 is transfer paper, 208 is a fixing apparatus, 209 is a cleaner and 210 is a developing apparatus.

In FIG. 3, 201 is a latent image-holding member, 202 is a developer-holding member, 203 is a roller charging device, 204 is a developer supplying roller, 205 is a layer forming blade, 206 is a transfer drum, 207 is transfer paper, 208 is a fixing apparatus, 209 is a cleaner, 210 is a developing apparatus and 211 is a Corotron charging device.

DESCRIPTION OF THE PREFERRED EMBODIMENTS

Figure 1:
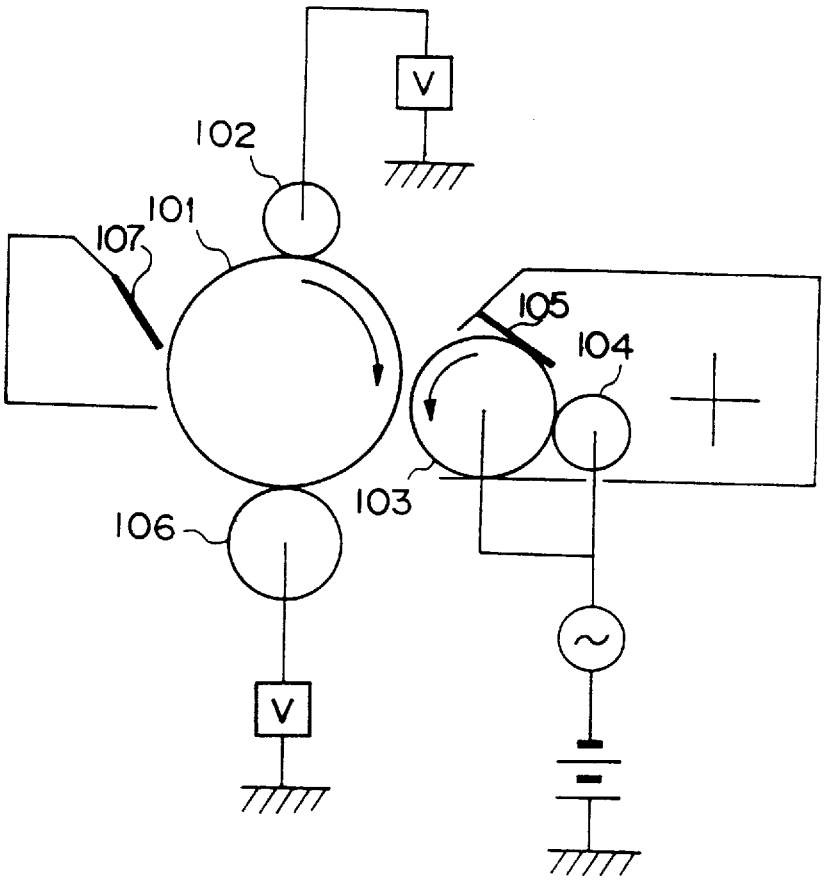
FIG. 1 is a block diagram of an image forming apparatus of a preferred embodiment applied to the method for forming an image according to the present invention.

The present invention is described below more in detail.

The non-magnetic mono-component developer of the present invention is used in a method for forming an image comprising a step of forming a latent image on a latent image-holding member, and a step of developing said latent image by making use of a developer on a developer-holding member. The non-magnetic mono-component developer of the present invention is used particularly preferably in an apparatus for forming an image comprising a step of transferring a toner image formed on the latent image-holding member to a transfer sheet, and a step of heat-fixing the toner image on the transfer sheet in addition to the latent image forming step and the developing step. More preferably, the non-magnetic mono-component developer is used in a full color developing apparatus using four color toners of yellow, magenta, cyan and black.

The conventional latent image forming step may be used for the present invention. For example, a electrostatic latent image is formed on the latent image-holding member such as photosensitive layer or dielectric layer, etc., by means of electrophotographic process or electrostatic recording process. The example of the latent image forming step may include a process of charging in non-contact by means of corona discharging device or a process of charging in contact with a charging material. The conventional photosensitive layer of the latent image-holding member may be used in the present invention such as organic type, amorphous silicon, etc. A cylindrical supporting member for holding the photosensitive layer may be obtained by the conventional producing method comprising extruding aluminum or aluminum alloy to mold and then surface-processing.

In the developing step, a toner is formed in a state of thin layer on a rotating cylindrical drum as a toner-holding member(developing roller) by means of elastic blade etc. and carried to development region. The developing roller and latent image-holding member for holding the latent image are arranged in the development region in contact with each other or in a definite closed space between them and an electrostatic latent image is developed by a toner under applying bias between the developing roller and the latent image-holding member. In case of the non-magnetic mono-component developer, a rotary drum containing a magnet therein used a toner-holding member.

The toner-holding member used in the present invention may include an elastic sleeve such as silicone, a sleeve formed by extruding ceramics or metals such as aluminum, SUS, nickel, etc., and those the surfaces of which are oxidized, metal-plated, ground, brushed, or coated with resin in order to control the carriageability of toner or chargeability. In particularly, if using the sleeve formed by extruding ceramics on metals such as aluminum, SUS, nickel, etc., the present invention may exert significant effects. The formation of the toner layer on the developing roller may be carried out by contacting the elastic blade with the surface of the sleeve. As the material of the elastic blade may be preferably used a rubber elastomer such as silicone rubber, urethane rubber, etc., and may be added and dispersed in the elastomer an organic or inorganic substance in order to control the charging amount of the toner.

The method for developing four color toners may include a-1) a system in which developing apparatuses of four colors are arranged around the photosensitive material and steps of charging/exposure of the photosensitive material and development of the electrostatic latent image are repeated with respect to each color toner in four cycles; a-2) a system in which the charging/exposure/development of four color toner is carried out in one cycle; and a-3) a system in which developing apparatuses of four toners are arranged to four photosensitive materials and the charging/exposure/development of four color toner are carried out in each photosensitive material and developing apparatus.

The method for superposing four color toner may include b-1) a system in which the toner image formed on the photosensitive materials is transferred and superinposed one color by one color onto the transfer drum around which a transfer paper is wound; b-2) a system in which the toner image formed on the photosensitive materials is transferred on the transfer sheet, and the color toner images are superimposed onto the transfer sheet, and then transferred collectively on the transfer sheet; and b-3) a system in which the color toner images are superinposed onto the photosensitive material and then transferred collectively onto the transfer paper.

Preferably, the method for forming a multicolor image according to the third aspect of the present invention makes use of the system a-1) and b-2) or b-3).

In the transferring step, the toner image formed on the latent image-holding member is transferred onto the transfer paper as transfer sheet. The method for forming a multicolor image according to the third aspect of the present invention comprises a collective transfer step of b-2) or b-3) as described above. The transferring means of the present invention may include conventional ones such as a contact type in which a transfer roller or transfer belt/drum is pressurized to contact with the latent image-holding member, a non-contact type using a corotron. The means of contact type is generally used for miniaturization of the apparatus. The present invention can exert its effect particularly in those of contact type, that is, those in which paper as transfer sheet is put between the latent image-holding member and the charging material is directly subject to contact/press and transferred.

In the cleaning step, the toner is removed, which remains in the latent image-holding member without being transferred in the transfer step. The cleaning means may include conventional one such as blade cleaning, roller cleaning, etc. An elastic rubber such as silicone rubber, urethane rubber, etc. may be used as the blade cleaning.

In the fixing step, the toner image transferred on the transfer sheet is fixed by means of a fixing apparatus. A heat roll is generally used as the heat-fixing means.

The developer used in the present invention comprises toner particles containing a binding resin and a colorant as well as optionally a charge controlling agent and an additive. The charge controlling agent is preferably a salicylic acid metal complex compound. The additive contains a titanium compound obtained by a reaction of $TiO(OH)_2$ with silane compound or by a reaction of $TiO(OH)_2$ with silicone oil. The additive preferably contains hydrophobic silica fine particles. The $TiO(OH)_2$ is produced by wet process, and the specific gravity of the titanium compound is preferably in the range of 2.8 to 3.6. When the specific gravity of the titanium compound is less than 2.8, while the elimination of titanium compound from the surface of toner decreases, the treatments tends to come away from the titanium compound because of increased reactions of the treatments themselves, the charging hindrance of the toner tends to easily occur because of filming on the photosensitive material or adhesion on the sleeve. When the specific gravity of the titanium compound is more than 3.6, the titanium compound itself tends to come away from the toner and the adhesion of the photosensitive material tends to easily occur, while the reaction of treatments themselves hardly occur and the treatments do not come away from the titanium compound.

In general, the method for producing titanium oxide by normal wet process is carried out through a chemical reaction in a solvent, and may be classified in two processes; one is sulfuric acid process, and another is hydrochloric acid process.

The sulfuric acid process is described briefly. The following reaction proceeds in a liquid phase, and insoluble $TiO(OH)_2$ is produced by hydrolysis.

$$FeTiO_3+2H_2SO_4 \rightarrow FeSO_4+TiOSO_4+2H_2O$$

$$TiOSO_4+2H_2O \rightarrow TiO(OH)_2+H_2SO_4$$

In the hydrochloric acid wet process, titanium tetrachloride is produced by chlorination according to analogous procedure to the dry process. Then, it is dissolved in water and hydrolyzed under an addition of strong base to produce $Tio(OH)_2$. The reaction formula is illustrated below;

$$TiCl_4+H_2O \rightarrow TiOCl_2+2HCl$$

$$TiOCl_2+2H_2O \rightarrow TiO(OH)_2+2HCl$$

The titanium compound used in the present invention may be produced by reacting the $TiO(OH)_2$ prepared in the wet process as described above with a silane compound or silicone oil, and drying. Since no calcination process at several temperatures is performed in the manufacturing process, a strong bonding of Ti—Ti is not formed and an agglomeration does not absolutely occur, and thus the particles may be taken out approximately in a state of primary particle. Further, since the titanium compound used in the present invention is produced by reacting directly $TiO(OH)_2$ with a silane compound or silicone oil, the amount treated thereby may be increased. While the titanium oxide conventionally treated had a low threshold value for treating amount contributing to the charging performance, the titanium compound used in the present invention has a high threshold value and can exert an effect on the treatment at about three times (about 50 to 70% on the basis of original titanium) in comparison with the conventional one. Therefore, the treating amount of silane compound can control the charge of the toner and can improve significantly the charging performance in comparison with the conventional titanium oxide. Further, since an excess silane compound is minimized and the reaction of silane compounds themselves is also decreased, high charge may be obtained without deterioration on charging speed and charging distribution in case of increasing treated amount. Further, the titanium compound used in the present invention migrates scarcely to the sleeve and the treatments do not also migrate therefrom, and thus the toner charge on the developer-carrier does not change over a long period of time because of little adhesion on the sleeve. Further, an adhesion on the photosensitive material does not absolutely occur and the defects in image quality do not also occur over a long period of time. This is because the titanium oxide used in the present invention do not come away from the surface of the toner for long-term use due to its strong adhesion to the surface of the toner because of the specific gravity of titanium oxide used in the present invention in the range of 2.8 to 3.6, which is lighter than conventional titanium oxide so that the migration of the treatments occurs scarcely, which is resulted from slight reaction of the silane compounds themselves to be treated(tightly bound to original body). Further, the titanium compound used in the present invention migrates scarcely to the sleeve and the treatments do not also migrate therefrom, and thus the toner charge on the developer-carrier does not change over a long period of time because of little adhesion on the sleeve. Further, an adhesion of toner to the photosensitive material does not absolutely occur and the defects in image quality do not also occur over a long period of time. This is presumably because the titanium oxide used in the present invention adheres tightly to the surface of the toner due to the specific gravity of titanium oxide used in the present invention in the range of 2.8 to 3.6, which is lighter than conventional titanium oxide.

Further, the titanium compound used in the present invention does not cause a phenomenon of hollow character even when a contact-transfer system is adopted. This is presumably because of low surface energy of silicone oil which is a treatment for titanium compound. That is, this is presumably because an agglomeration of toner itself does not occur due to low surface energy of the silicone oil even when the stress by pressure-contact is applied at the time of contact-transfer.

In the present invention, the titanium compound having a resistance of between $10^8$ and $10^{12}$ Ω·cm is used to control the charging distribution for prevention of fogging and improvement of developing property. When the resistance is less than $10^8$ Ω·cm, the chargeability of the toner decreases and thus the fogging and flying of toner tend to occur. On the other hand, when the resistance is more than $10^{12}$ Ω·cm, the charging distribution of the toner becomes broad and the toner having two layers tends to easily occur because of the fogging by reverse polar toners and an adhesion of highly charged toner to the developer-holding member.

The average primary particle diameter of the titanium compound used in the present invention is less than 100 nm, preferably in the range of 10 to 70 nm. When the average primary particle diameter is more than 100 nm, a satisfactory fluidity can not be imparted to the toner, and the titanium compound tends to come away from the toner, which causes easily filming or comet to the photosensitive material. On the other hand, when the average primary particle diameter is less than 10 nm, an agglomeration of particle becomes remarkably intensified and a dispersibility to the surface of the toner is deteriorated. As a result, satisfactory chargeability and fluidity can not be obtained. A shortening of the particle diameter of the toner makes an adhesive force increase, and thus a failure of transfer may occur. In order to prevent such the failure of transfer, a silica or titania having large particle diameter is used as second external additive (transfer auxiliary), which may be available also in the present invention. When using such the titania of large particle diameter in the mono-component developer of the present invention, a good transferring property may be obtained without low charge, environmental dependency and lowering of admixing property (broadening of charging distribution for long run) resulted from second external additive. Also, lowering of charge imparting property at long term stress resulted from coming away of the treatments. In order to improve a failure upon transferring when the superimposed toner images are transferred collectively to a final transfer sheet, a silica having BET specific surface area of between 20 and 100 $m^2/g$ may be used in combination with the titanium compound to make a compatibility of the stability of charging with transferring property possible.

The silane compound used in the present invention may include any types of silane compounds, for example, chlorosilane, alkoxysilane, silazane, specialty silylating agent. Specific examples thereof may include, but not limit to, methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane γ-mercaptopropyltrimethoxysilane, γ-chloropropyltrimethoxysilane.

Although the amount of the silane compound varies depending on the primary particle diameter of original material of $TiO(OH)_2$, the amount of the silane compound is, in general, in the range of 5 to 80 parts by weight, preferably in the range of 10 to 50 parts by weight based on 100 parts by weight of the original material of $TiO(OH)_2$. When the amount is less than 5 parts by weight, the silane compound to be treated can not exert its function. When the amount is more than 80 parts by weight, the titanium compound becomes oily because of excess silane compound, and thus the fluidity of the toner begins to become worse. The amount of the silane compound should be properly adjusted depending on kinds of toner to be used, developer-holding member, particle diameter of the original material of $TiO(OH)_2$, etc., in order to impart the high charge to the toner, to improve the environmental dependency, to increase the fluidity of the toner, to reduce the interaction of photosensitive material, and to prevent hollow character in the contact-transfer system.

The titanium compound used in the present invention may be obtained by the reaction of $TiO(OH)_2$, especially $TiO(OH)_2$ prepared by wet process with a silicone oil or silicone varnish.

As the silicone oil used in the present invention may be preferable those illustrated by the following general formula;

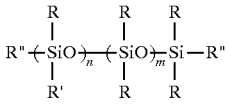

(wherein R is an alkyl group having 1 to 3 carbon atoms; R' is alkyl group, halogen-modified alkyl group, phenyl group, or modified phenyl group; R" is an alkyl group or alkoxy group having 1 to 3 carbon atoms; and m and n are integer.)

These silicone oils may include, but not limited to, dimethylsilicone oil, methylhydrogensilicone oil, methylphenylsilicone oil, alkyl-modified silicone oil, α-methylsulfon-modified silicone oil, chlorophenylsilicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, higher fatty acid-modified silicone oil, fluorine-modified silicone oil, etc.

Although the treated amount of the silicone oil varies depending on the primary particle diameter of original material of $TiO(OH)_2$, the amount of silicone oil is, in general, in the range of 5 to 80 parts by weight, preferably in the range of 10 to 50 parts by weight based on 100 parts by weight of the original material of $TiO(OH)_2$. When the amount is less than 5 parts by weight, the silicone oil to be treated can not exert its function. When such the amount is more than 80 parts by weight, the titanium compound becomes oily because of excess silicone oil, and thus the fluidity of the toner begins to become worse. The amount should be properly adjusted depending on kinds of toner to be used, developer-holding member, particle diameter of the original material of $TiO(OH)_2$, and the like, in order to impart the high charge to the toner, to improve the environmental dependency, to increase the fluidity of the toner, to reduce the interaction of photosensitive material, and to prevent hollow character in the contact-transfer system.

The treatment procedure of the silicone oil to $TiO(OH)_2$ may be carried out by mixing silicone oil with a dispersion of $TiO(OH)_2$ or by mixing s solution or suspension of silicone oil with an organic solvent in a dispersion of $TiO(OH)_2$ to react each other. Then, the reaction product is filtered and dried to obtain desired product.

Although the amount of additive (titanium compound) to be added to the toner varies depending on the particle diameter, such as composition of the developer-holding member and the like, it is in the range of 0.1 to 5.0 parts by weight, preferably in the range of 0.2 to 2.0 parts by weight based on 100 parts by weight of the toner. When the amount of additive is less than 0.1 parts by weight, the fluidity of the toner can not be obtained. When the amount of additive is more than 5.0 parts by weight, a rise or lowering in fixing temperature may be resulted at the fixing step, and simultaneously a color developing property of superinposed under-layer may be hindered because of lowering of light transmission properties.

In the present invention, another fine particles may be used as fluidizing agent in addition to the titanium compound in combination therewith for the purpose of assistance to proper fluidity and chargeability of the developer. The fine particle used as fluidizing agent may include inorganic fine particles such as silica, alumina, and the like; organic fine particles such as fatty acid or derivatives thereof and metal salts thereof; and resin fine particles such as fluororesin, acrylic resin and styrene resin. Most preferably, it may be silica fine particles. The surface of the silica fine particles used in the present invention may be treated with silane coupling agent or silicone oil to be hydrophobic, in order to improve chargeability and environmental stability. The silica treated with silicone oil may be preferable in terms of the environmental stability, agglomeration property of the toner and low adhesion of the toner to the photosensitive material.

BET specific surface area of the hydrophobic silica to be used is in the range of 20 to 300 $m^2/g$, preferably in the range of 30 to 200 $m^2/g$, more preferably in the range of 40 to 120 $m^2/g$. When BET specific surface area is less than 20 $m^2/g$, the hydrophobic silica tends to be easily dissolved from the surface of the toner, and filming or comet of the photosensitive materials also tends to occur, while an agglomeration becomes too worse to be fully dispersed on the surface of the toner when it is more 300 $m^2/g$.

When the silica is used in the multicolor image forming process comprising a collective-transfer step according to the third aspect of the present invention, BET specific surface area of the silica is preferably in the range of 20 to 100 $m^2/g$. A variety of surface treated silica within the range may be used since the following disadvantage tend to occur in the multicolor image forming process comprising a collective-transfer step; when BET specific surface area is less than 20 m/g, a lacking in uniformity of image tends to occur because of decreased fluidity of the toner, while when it is more than 100 $m^2/g$, a transfer failure tends to occur in the toner, especially in the toner of the bottom layer. In this case, the amount of silica to be added to the toner is in the range of 0.1 to 5.0 parts by weight, preferably in the range of 0.2 to 2.0 parts by weight based on 100 parts by weight of the toner. When the amount is less than 0.1 parts by weight, the effect on the improvement of the transfer failure is not sufficient, while when more than 5.0 parts by weight, the lacking in unevenness of image tends to occur because of decreased fluidity of the toner.

In the multicolor image forming process comprising a collective-transfer step according to the third aspect of the present invention, the ratio of the titanium compound to the silica is preferably in the range of 1:10 to 10:1. When the ratio is out of range, there may be a tendency that the developing property and transferring property can not be satisfactorily improved at the same time.

These fine particles are preferably used in the range of 0.1 to 3 parts by weight, more preferably in the range of 0.3 to 1.5 parts by weight based on 100 parts by weight of the toner. When the amount is less than 0.1 parts by weight, a sufficient effect can not be imparted because of decreased surface coating of the toner by the fine particle. On the other hand, when the amount is more than 3 parts by weight, a comet or filming tends to easily occur because of adhesion of the fine particle to the photosensitive material. Furthermore, an environmental stability becomes worse.

In the present invention, the toner particle used in the present invention may be essentially a conventional one comprising a binding resin and a colorant. Specific examples of the binding resin used include a monopolymer or copolymer of styrenes such as styrene, chlorostyrene, etc.; monoolefins such as ethylene, propylene, butylene, isoprene, etc.; vinylesters such as vinylacetate, vinylpropionate, vinylbenzoate, vinylbutyrate, etc.; α-methylene aliphatic monocarboxylic acid esters such as methylacrylate, ethylacrylate, butylacrylate, dodecylacrylate, octylacrylate, phenylacrylate, methylmethacrylate, ethylmethacrylate, butylmethacrylate, dodecylmethacrylate, etc.; vinylethers such as vinylmethylether, vinylethylether, vinylbutylether, etc.; or vinylketones such as vinylmethylketone, vinylhexylketone, vinylisopropenylketone, etc.

The typical binding resin may include polystyrene, styrene-alkylacrylate copolymer, styrene-alkylmethacrylate copolymer, styrene-acrylic nitril copolymer, styrene-butadiene copolymer, styrene-maleic anhydride copolymer, polyethylene, polypropylene, etc. Further, the typical binding resin may include polyester, polyurethane, epoxy resin, silicone resin, polyamide, modified rosin, paraffin wax, etc. Polyesters are preferable in terms of color development/image intensity, more preferably, polyester resins having a softening point of 90–120° C., preferably of 95–115° C. in terms of charging/keeping property of forming layer in the non-magnetic mono-component development.

The term "softening point" as used herein means the temperature at the melt viscosity $10^4$ Pas ($10^5$ poises) measured by a flow tester (manufactured by SHIMAZU SEISAKUSHO Co.Ltd., nozzle of 1×1 mm, load=10 kg). Although a color development becomes more better because of decreased fixing temperature and surface evenness of fixed image at the softening point below 90° C., problems of offset to a heatroll at high temperatures or the decreased image intensity tend to easily arise and problems of lines or charging failure also tend to easily arise when repeatedly using because of the adhesion of the toner to the developer-carrier or layer forming blade. Although an adhesion of the toner to the developer-carrier or layer forming blade scarcely occurs and thus the development keeping property may be stabilized at the softening point of above 120° C., a color development or OHP light transmission property comes into question because of deterioration of fixing property at low temperatures.

Polyester resins having the glass transition temperature (Tg) of between 60° C. and 75° C., preferably 62 and 70° C. may be used in terms of an improvement of development keeping property to prevent adhering of the toner to the development-holding member or layer forming blade together with fixing property, blocking property and improved image. The glass transition temperature as used herein may be obtained from the Shoulder value in DSC curve measured by means of a differential scanning type calorimeter DSC-50 (manufactured by SHIMAZU SEISAKUSHO Co. Ltd., temperature-rising speed=10° C./min., standard substance=alumina).

When the Tg of the polyester is less than 60° C., the blocking occurs and the storability lowers, while the fixing property lowers at Tg above 70° C.

The composition of the polyester resins in the present invention may be usually used a conventional monomer composition. The examples of an acid component may include phthalic acid, terephthalic acid, isophthalic acid, fumaric acid, maleic acid, etc. The example of an alcohol component may include ethyleneglycol, propyleneglycol, glycerin, bisphenol-A, etc. Preferably the polyester resins may contain an aromatic dicarboxylic acid such as terephthalic acid and an aromatic diaicohol such as bisphenol-A as main components.

The colorant for the toner may include carbon black, Aniline Blue, Chalcoil Blue, chrome yellow, ultramarine blue, Du Pont Oil Red, Quinoline Yellow, Methylene Blue Chloride, Phthalocyanine Blue, Malachite Green Oxalate, lamp black, Rose Bengal, C.I. Pigment Red 48:1, C.I. Pigment Red 12:2, C.I. Pigment Red 57:1, C.I. Pigment Yellow 97, C.I. Pigment Yellow 12, C.I. Pigment Yellow 17, C.I. Pigment Black 15:1, C.I. Pigment Blue 15:3, etc. These colorants may be dispersed directly in the binding resin by means of a kneader, or a masterbatch or flushing coloring material may be adopted to improve the dispersion of the colorants in the resin and color development.

A releasing agent may be added to the developer used in the present invention in order to improve the gloss and offset. Preferably, the releasing agent may include paraffin or polyparaffin having carbon atoms of more than eight, and may include paraffin wax, paraffin latex, microcrystalline wax, etc., or polypropylene, polyethylene, etc. These releasing agent may be used alone or in combination therewith. The amount thereof is preferably in the range of 0.3 to 10% by weight.

A charge controlling agent may be added to the toner used in the present invention, if it is necessary. The charge controlling agent may include convnetional ones, for example, fluorine-containing surfactant; metal-containing dye such as salicylic acid metal complex, azo-metal compound, etc.; polyacid such as copolymer containing maleic acid as a monomer component, etc.; quatenary ammonium salt; azine-dye such as Nigrosine, etc.; carbon black; or charge controlling resin, etc. One example of the salicylic acid metal complex may be illustrated the compounds having the following structural formulae. When these compounds are added to the toner particles in addition to the titanium compound aforesaid, the charging amount of toner on the sleeve and carriage/layer forming state at continuous use may be significantly stabilized and an environmental dependency of charging may be significantly reduced.

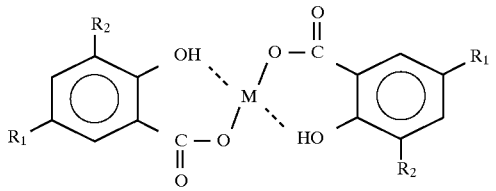

(wherein M is an atom selected from the group consisting of Zn, Fe, Ni, and Co. $R_1$ and $R_2$ are independently hydrogen atom or alkyl group having 1 to 6 carbon atoms.)

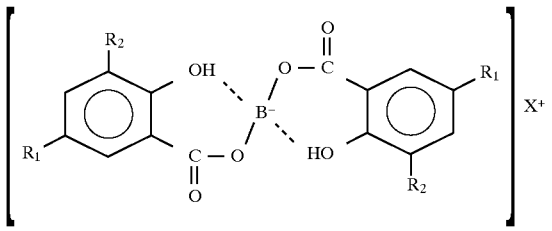

(wherein M is an atom selected from the group consisting of Cr, Ni, and Co. $R_1$ and $R_2$ are independently hydrogen atom or alkyl group having 1 to 6 carbon atoms. $X^+$ is a counter ion such as $H^+$, $Na^+$, $K^+$, $NH_4^+$, etc.)

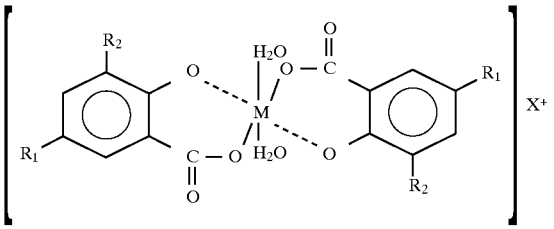

(wherein M is an atom selected from the group consisting of Cr, Ni, and Co. $R_1$ and $R_2$ are independently hydrogen atom or alkyl group having 1 to 6 carbon atoms. $X^+$ is a counter ion such as $H^+$, $Na^+$, $K^+$, $NH_4^+$, etc.)

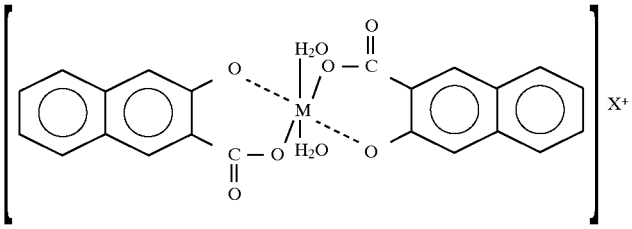

(wherein M is an atom selected from the group consisting of Cr, Ni, and Co. $R_1$ and $R_2$ are independently hydrogen atom or alkyl group having 1 to 6 carbon atoms. $X^+$ is a counter ion such as $H^+$, $Na^+$, $K^+$, $NH_4^+$, etc.)

Of these charge controlling agent, the salicylic acid metal complex having Zn, B, or Cr atom illustrated by the following structural formulae may be preferable in terms of sharpness of the charging distribution and admixing property, more preferably the salicylic acid metal complex having Zn atom. These charge controlling agent may be used in the range of 0.1 to 10 weight percent, preferably in the range of 1 to 7 weight percent based on the resin.

When the amount of the charge controlling agent based on the resin is less than 0.1% by weight, charge keeping property can not be obtained. The offset and image intensity decrease, which cause a fixation failure, when more than 10% by weight.

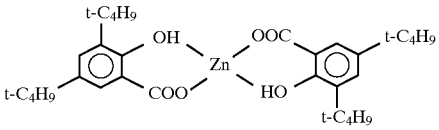

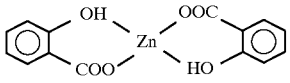

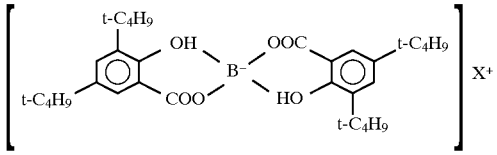

(wherein, $X^+$ is a counter ion such as $H^+$, $Na^+$, $K^+$, $NH_4^+$, etc.)

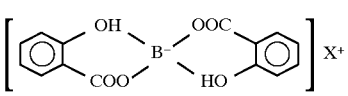

(wherein, $X^+$ is a counter ion such as $H^+$, $Na^+$, $K^+$, $NH_4^+$, etc.)

-continued

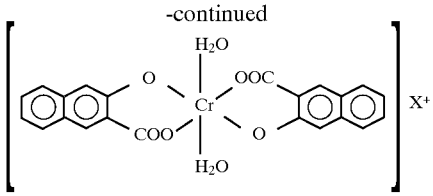

(wherein, $X^+$ is a counter ion such as $H^+$, $Na^+$, $K^+$, $NH_4^+$, etc.)

A releasing agent may be added to the toner used in the present invention in order to improve anti-offset property. A paraffin, polyolefin, etc., having carbon atoms of more than eight, for example, paraffin wax, paraffin latex, microcrystalline wax, etc, or polupropylene, polyethylene, etc. may be preferable as the releasing agent. These releasing agents may be used alone or in combination therewith preferably in the range of 0.3 to 10% by weight.

The particle diameter of the toner used in the present invention is in the range of 3 to 15 $\mu$m, preferably in the range of 5 to 10 $\mu$m by volume average particle diameter. When the volume average particle diameter is less than 3 $\mu$m, the layer can not be satisfactorily formed due to the decreased fluidity, and thus fogging or dirt may be caused. On the other hand, when it is more than 15 $\mu$m, a high image quality can not be obtained due to decreased resolution, and lines tend to easily occur in the layer on the development sleeve because of coarse particles.

The toner used in the present invention may be produced by any conventional methods, more preferably, a kneading, pulverization, etc. The process may be preferable, which comprises the step of: melting and kneading a binding resin and a colorant, and optionally a charging-controlling agent by means of a kneading apparatus such as a kneader or extruder, etc., cooling, and pulverizing by means of a jet mill or mechanical pulverizer, air-classifying, and then adding and mixing additives.

In the present invention, the titanium compound and optionally silica are added to the toner particles, and mixed. Mixing may be carried out by means of a V-type blender or Henschel mixer, Redige mixer, etc. In this step, a various kinds of additives may be added, if necessary. Examples of these additives may include fine particles magnetite and cerium oxide, etc. as an abrasive; organic fine particles of polystyrene/polymethylmethacrylate, etc.; or inorganic fine particles of titanium oxide etc. having relatively large particle diameter as a development/transfer auxiliary, fine particles of polyvinylidene fluoride etc. as a cleaning auxiliary.

If necessary, the coarse particles of the toner may be removed by means of a vibratory screen classifier or an air screen classifier.

The amount of charge of the toner used in the present invention is measured by a blow-off charge measuring device manufactured by TOSHIBA CHEMICAL Co. Ltd. after mixing 30 g of iron powder having 100 $\mu$m diameter with 1.2 g of the toner by means of a tubular mixer with stirring for 60 seconds. The measurement was carried out under ambient temperature of 22° C. and humidity of 55%.

The particle size of the toner used in the present invention was measured by means of a Granulometer TA-II having an aperture of 100 $\mu$m diameter manufactured by COALTER COUNTER Co. Ltd.

The specific gravity of the titanium compound used in the present in the present invention is measured by means of a Le Chatelie's specific gravity bottle according to JIS-K-0061 5-2-1. The procedures are as follows;

i) About 250 ml of water are added to the Le Chatelie's specific gravity bottle and adjusted the meniscus to the scale.

ii) The specific bottle is immersed in a constant temperature water bath and the position of the meniscus is accurately read off by the scale of the specific gravity bottle when the temperature of the water comes to 20.0°±0.2° C. (The precision is 0.025 ml).

iii) About 100 g of samples are weighed in order of 1 mg and the weight thereof is indicated by W.

iv) The samples weighed are put in the specific gravity bottle and bubbles are removed.

v) The specific gravity bottle is immersed in the constant temperature water bath and the position of the meniscus is accurately read off by the scale of the specific gravity bottle while maintaining the temperature of the water at 20.0°±0.2° C. (The precision is 0.025 ml).

vi) The specific gravity is calculated by the following procedures;

$$D=W/(L_2-L_1)$$

$$S=D/0.9982$$

wherein D is density (20° C.)(g/cm$^3$);

S is specific gravity of the sample (20°/20° C.);

W is apparent weight of the sample (g);

$L_1$ is reading of the meniscus before the sample is put in the specific gravity bottle (20° C.)(ml);

$L_2$ is reading of the meniscus after the sample was put in the specific gravity bottle (20° C.)(ml);

0.9982 is density of water at 20° C. (g/cm$^3$).

The method for measuring BET specific surface area is as follows;

The surface area is measured by means of BETA-SOAP auto surface measuring apparatus (Model 4200, manufactured by NIKKISO Co. Ltd.) using mixed gas of nitrogen and helium.

The method for forming a multicolor image according to the third aspect of the present invention comprises at least a step of developing repeatedly a latent image formed on a latent image-holding member by plural developers, and a step of transferring collectively on transfer sheet a multicolor toner image formed by superimposition on said latent image-holding member or intermediate transfer sheet, and more in detail, comprises a step of forming the latent image on the latent image-holding member, a step of developing repeatedly said latent image formed on said latent image-holding member by plural developers, a step of transferring collectively on transfer paper a toner image formed by superimposition on said latent image-holding member or intermediate transfer sheet, and a step of heat-fixing said toner image on said transfer paper.

The method for forming a multicolor image according to the third aspect of the present invention is able to make use of similar image-forming processes and similar developers to those used in the image-forming processes according to the first and second aspects of the present invention.

EXAMPLES

Although the present invention is described with reference to Examples, it should be understood that the present invention is not limited thereto. In the following description, the 'part' means 'part by weight', unless otherwise noted.

In the present invention, the titanium oxide formed by wet process, that is, sulfuric acid process or hydrochloric acid process may be used. The titanium oxide used in Examples was prepared by wet sedimentation process comprising dissolving an ilmenite ore in sulfuric acid to separate iron therefrom, and hydrolyzing $TiOSO_4$ to form $TiO(OH)_2$.

The key techniques in this preparation are hydrolysis and controlling of dispersion for the preparation of nuclei, and controlling of agglomeration of nuclei particles and rinsing of nuclei particles. In particularly, a controlling at high level of a pH-adjustment (neutralization of acid) and the concentration of slurry in the dispersion treatment/controlling of agglomeration of nuclei particles are required to determine the primary particle of titanium compound in succeeding step, including adjustment of pH, temperature, etc., at the step of treatment of silicone oil.

Preparation of External Additive I-A 25 parts by weight of dimethylsilicone oil (KF 96:made from SHINETSU KAGAKUKOHGYOH CO. LTD.) were added to 100 parts of $TiO(OH)_2$ prepared by the above-mentioned procedure and mixed while heating, then rinsing, filtrating, drying at 120° C., deagglomerating soft agglomeration by a pin mill to obtain a titanium compound, External Additive I-A having an average primary particle diameter of 3 nm and a specific gravity of 3.3.

Preparation of External Additive I-B

Similar procedures to those for External Additive I-A were repeated except that the pH-adjustment for the adjustment of particle diameter and dispersion/agglomeration controlling step were changed, to obtain a titanium compound, External Additive I-B having an average primary particle diameter of 25 nm and a specific gravity of 3.1.

Preparation of External Additive I-C

Similar procedures to those for External Additive I-B were repeated except that the addition amount of silicone oil were changed to 40 parts by weight, to obtain a titanium compound, External Additive I-C having an average primary particle diameter of 25 nm and a specific gravity of 3.1.

Preparation of External Additive I-D

Similar procedures to those for External Additive I-A were repeated except that a fluorine-modified silicone oil (X-70-180A: made from SHINETSU KAGAKUKOHGYOH CO.LTD.) was used for the dimethylsilicone oil, to obtain a titanium compound, External Additive I-D having an average primary particle diameter of 35 nm and a specific gravity of 3.4.

Preparation of External Additive I-E

Similar procedures to those for External Additive I-A were repeated except that a carboxyl-modified silicone oil (X-22-3701E; made from SHINETSU KAGAKUKOHGYOH CO.LTD.) was used for the dimethylsilicone oil, to obtain a titanium compound, External Additive I-E having an average primary particle diameter of 35 nm and a specific gravity of 3.3.

Preparation of External Additive I-F $TiO(OH)_2$ prepared by the procedures as described above was rinsed, filtrated and calcined to obtain a titanium compound having an average primary particle diameter of 35 nm. Then, it was pulverized by means of a jet mill, and 100 parts by weight of titania compound were treated under dry with 25 parts by weight of dimethylsilicone oil in fluidized bed to obtain a titanium compound, External Additive I-F having an average primary particle diameter of 35 nm and a specific gravity of 4.0.

Preparation of External Additive I-G $TiO(OH)_2$ prepared by the procedures as described above was rinsed, filtrated and calcined to obtain a titanium compound having an average primary particle diameter of 35 nm. Then, it was pulverized by means of a jet mill, and dispersed in methanol, and then 40 parts by weight of dimethylsilicone oil were added to 100 parts by weight of titania. After the treatment, a wet pulverizing was carried out by means of a sand grinder, then the solvent was removed while stirring by a kneader, and finally dried to obtain External Additive I-G (specific gravity=3.9).

Preparation of External Additive I-H $TiO(OH)_2$ prepared by the procedures as described above was rinsed, filtrated and calcined to obtain a titanium compound having an average primary particle diameter of 25 nm. Then, it was dispersed again in water, and wet-pulverized by means of a sand grinder, and then, in the water, 40 parts by weight of isobuthyltrimethoxysilane were mixed, stirred, heat-treated, dried, and pulverized by means of a jet mill to obtain External Additive I-H having a specific gravity of 3.9.

Preparation of External Additive I-I

The similar procedures to those for External Additive I-H were repeated except that the amount was changed to 10 parts by weight to obtain External Additive I-I having an average primary particle diameter of 25 nm and a specific gravity of 3.8.

Preparation of Toner Grain I-X

Binding resin (terephthalic acid/bisphenol-A propylene oxide adduct, Mw=18,500, Tg=68° C.): 96 parts Phthalocyanine pigment(C. I. Pigment Blue 15:3): 4 parts The above described materials were mixed by means of Henschel mixer, kneaded in a molten state by Bumbury's mixer, and pulverized after being cooled, and then classified by means of a screen classifier to obtain a Toner Grain I-X having average particle diameter of 8 μm. The charging amount of the Toner Grain I-X was −8 μc/g.

Preparation of Toner Grain I-Y

Binding resin (terephthalic acid/bisphenol-A propylene oxide adduct, Mw=35,000, Tg=66° C.): 89 parts Carbon black(BP1300: made from Cabot): 9 parts Charging-controlling agent(BONTRON E88: made from ORIENT KAGAKU KOHGYOH CO.LTD.): 2 parts The above described materials were mixed by means of Henschel mixer, kneaded in a molten state by Bumbury's mixer, and pulverized after being cooled, and then classified by means of a screen classifier to obtain a Toner Grain I-Y having average particle diameter of 7.5 μm. The charging amount of the Toner Grain I-Y was −12 μc/g.

Reparation of Toner Grain T-Z

Binding resin (styrene-n-butylacrylate copolymer, copolymeriation ratio: 85/15, MW=13,500, Tg=64° C.): 90 parts Yellow pigment (C.I. Pigment Yellow 97): 4 parts Polypropylene of low molecular weight (Viscole 660P: made from SANYOH KASEI CO.LTD.): 4 parts Polyethylene of low molecular weight (molecular weight=6,000): 2 parts The above described materials were mixed by means of Henschel mixer, kneaded in a molten state by a continuous keading apparatus (TEM 35) manufactured by TOSHIBA KIKAI CO.LTD., and pulverized by I-type mill after being cooled, and then classified by means of an inertia-type screen classifier to obtain Toner Grain I-Z having average particle diameter of 7 μm. The charging amount of Toner Grain I-Z was −10 μC/g.

An Image Forming Apparatus

FIG. 1 shows the image forming apparatus used for evaluation of the image quality in the present invention. The latent image-holding member 101 and the developer-holding member 103 were arranged with maintaining a definite space between them. The latent image-holding member 101 was designed so that an electrostatic latent image could be formed by exposure to the laser light after being charged by the roller charger 102, and the alternating voltage and direct voltage were applied to the developer-holding member 103 and developer-supplying roller 104 to develop the latent image. The layer-forming blade of silicone rubber 105 was contacted directly with the developer-holding member 103 at constant line pressure to form a thin layer of the toner. The peripheral speed of the latent image-holding member (photosensitive material) 101 was 60 mm/s and that of the developing roll 103 was 90 mm/s. The roller transferring apparatus 106 was used to transfer of the toner, and the blade-type cleaner 107 was used for cleaning. The developer-holding member 103 was made from alumite.

EXAMPLE 1

1.0 part by weight of External Additive I-A was added to 100 parts by weight of Toner Grain I-X and mixed together by means of Henschel mixer, and classified by means of air screen classifier having a mesh diameter of 45 μm to obtain Developer I-1. The charging amount of Developer I-1 was −32 μC/g.

EXAMPLE 2

The same procedures as those of Example 1 were repeated except that External Additive I-A was replaced with External Additive I-B to obtain Developer I-2. The charging amount of Developer I-2 was −28 μC/g.

EXAMPLE 3

The same procedures as those of Example 1 were repeated except that External Additive I-A was replaced with External Additive I-C to obtain Developer I-3. The charging amount of Developer I-3 was −29 μC/g.

EXAMPLE 4

The same procedures as those of Example 1 were repeated except that External Additive I-A was replaced with External Additive I-D to obtain Developer I-4. The charging amount of Developer I-4 was −34 μC/g.

EXAMPLE 5

The same procedures as those of Example 2 were repeated except that Toner Grain I-X was replaced with Toner Grain I-Y to obtain Developer I-5. The charging amount of Developer I-5 was −40 μC/g.

EXAMPLE 6

The same procedures as those of Example 5 were repeated except that External Additive I-B was replaced with External Additive I-E to obtain Developer I-6. The charging amount of Developer I-6 was −35 μC/g.

EXAMPLE 7

The same procedures as those of Example 3 were repeated except that Toner Grain I-X was replaced with Toner Grain I-Z to obtain Developer I-7. The charging amount of Developer I-7 was −27 μC/g.

EXAMPLE 8

The same procedures as those of Example 7 were repeated except that External Additive I-C was replaced with External Additive I-D to obtain Developer I-8. The charging amount of Developer I-8 was −31 μC/g.

EXAMPLE 9

The same procedures as those of Example 8 were repeated except that the amount of External Additive added was replaced with 0.5 parts by weight to obtain Developer I-9. The charging amount of Developer I-9 was −27 μC/g.

Comparative Example 1

The same procedures as those of Example 1 were repeated except that External Additive I-A was replaced with External Additive I-F to obtain Developer I-10. The charging amount of Developer I-10 was −19 μC/g.

Comparative Example 2

The same procedures as those of Example 1 were repeated except that External Additive I-A was replaced with External Additive I-G to obtain Developer I-11. The charging amount of Developer I-11 was −23 μC/g.

Comparative Example 3

The same procedures as those of Example 1 were repeated except that External Additive I-A was replaced with External Additive I-H to obtain Developer I-12. The charging amount of Developer I-12 was −21 μC/g.

Comparative Example 4

The same procedures as those of Example 1 were repeated except that External Additive I-A was replaced with an amorphous titanium of 30 nm particle diameter to obtain Developer I-13. The charging amount of Developer I-13 was −5 μC/g.

Comparative Example 5

The same procedures as those of Example 5 were repeated except that External Additive I-B was replaced with External Additive I-G to obtain Developer I-14. The charging amount of Developer I-14 was −21 μC/g.

Comparative Example 6

The same procedures as those of Example 5 were repeated except that External Additive I-B was replaced with a silica fine particle of 16 nm particle diameter treated with dimethylsilicone oil to obtain Developer I-15. The charging amount of Developer I-15 was −25 μC/g.

Comparative Example 7

The same procedures as those of Example 5 were repeated except that External Additive I-B was replaced with a silica fine particle of 12 nm particle diameter treated with hexamethylsilazane to obtain Developer I-16. The charging amount of Developer I-16 was −23 μC/g.

Comparative Example 8

The same procedures as those of Example 7 were repeated except that External Additive I-C was replaced with External Additive I-F to obtain Developer I-17. The charging amount of Developer I-17 was −16 μC/g.

Comparative Example 9

The same procedures as those of Example 7 were repeated except that External Additive I-C was replaced with a silica fine particle of 16 nm particle diameter treated with fluorine-denatured silicone oil (same kind of External Additive I-D) to obtain Developer I-18. The charging amount of Developer I-18 was −26 μC/g.

Comparative Example 10

The same procedures as those of Example 7 were repeated except that External Additive I-C was replaced with 0.5 parts by weight of a silica fine particle of 12 nm particle diameter treated with dimethylsilicone oil and External Additive I-H of 0.5 parts by weight to obtain Developer I-19. The charging amount of Developer I-19 was −18 μC/g.

Developers I-1 through I-19 obtained by the processes as described above were subjected to printing test for 10,000 sheets of paper under both of the environment of high temperature and high humidity at 30° C. and 90% RH, respectively, and low temperature and low humidity at 10° C. and 20% RH, respectively, by the image forming apparatus illustrated in FIG. 1. The results were shown in Table 1.

The evaluation of each characteristic in Table 1 was according to the following;

Toner Fluidity (*1)

Toner fluidity was evaluated by making use of off-line auger dispenser. Dispenser desired was ≧700 mg/sec.

Initial Charging Amount (*2)

The toner was carried on the sleeve, and was allowed to stand under each environment for 24 hours. Evaluated under each environment by means of suction tribo-measuring method. The charging amount after carriage of 10,000 sheets of paper was measured by the same method as described above.

Total Evaluation of Charging (*3)

1)Difference in Charging Under Different Environments

Difference in charging under different environment=½ {initial charging amount(at high temperature and high humidity)/(at low temperature and low humidity)] +charging amount after carriage of 10,000 sheets of paper(at high temperature and high humidity)/(at low temperature and low humidity)]}.

Criteria for evaluation of difference charging under different environment: ○≧0.7, Δ≧0.5, ×<0.5, 2) Keeping Property Keeping property=½ [charging amount at high temperature and high humidity (charging amount after carriage of 10,000 sheets of paper)/(initial charging amount)+charging amount at low temperature and low humidity(charging amount after carriage of 10,000 sheets of paper)/(initial charging amount)].

Criteria for evaluation of keeping property: ○≧0.8, Δ≧0.5, ×<0.5

3)Charging Distribution

Charging distribution was obtained by measuring the charging distribution on the sleeve after carriage of 10,000 sheets of paper by means of charging distribution measuring apparatus and by dividing the central value of the distribution by the breadth of the distribution. Criteria for evaluation of charging amount: ○≧0.6, Δ≧0.4, ×<0.4

Total Evaluation of Image Quality (*4)

i) fogging

Sensory evaluation by observation of background with the aid of 50× magnifier.

Criteria for evaluation of fogging: =nil, Δ=several, ×=fairly, ××=beyond evaluation.

ii) unevenness in image density/carriage failure Solid evaluation—Density was measured at three points (from upper to lower side in A4 sized paper) by means of Macbeth densitometer to evaluate.

iii) density keeping property

The densities of initial copy and the 10,000th copy were measured respectively by means of Macbeth densitometer to evaluate iv) failure in image quality The failure in image quality because of defects of photosensitive material was visually evaluated.

v) internal adhesion of the apparatus

The state of deposition because of flying of the toner and sleeve line was visually evaluated.

vi) hollow character

The state of hollow character in the region of line of 0.1 mm width was visually evaluated. .

Criteria for evaluation of hollow character: ○=nil, Δ=several, ×=fairly, ××=beyond evaluation.

controlling to control the particle diameter were changed and 40 parts by weight of isobutyltrimethoxysilane were mixed to obtain a titanium compound, External Additive II-B having particle diameter of 50 nm, specific gravity of 3.1 and resistance of $9.8\times10^{9}$ Ω·cm.

Preparation of External Additive II-C

The similar procedures to those for External Additive II-B were carried out except that PH-adjustment and dispersion controlling to control the particle diameter were changed to obtain a titanium compound, External Additive II-C having particle diameter of 70 nm, specific gravity of 3.1 and resistance of $8.5\times10^{9}$Ω·cm.

Preparation of External Additive II-D

The similar procedures to those for External Additive II-A were carried out except that isobutyltrimethoxysilane was replaced with decyltrimethoxysilane to obtain a titanium compound, External Additive II-D having particle diameter of 30 nm, specific gravity of 3.4 and resistance of $8.0\times10^{10}$Ω·. cm.

TABLE 1

| | | Initial charging amount (μC/g)*2 | | Charging amount after carriage of 1000 sheets of paper (μC/g) | | Total evaluation of charging (After 10,000)*3 | | | Total evaluation of image quality(*4) | | | | | |
|---|---|---|---|---|---|---|---|---|---|---|---|---|---|---|
| | Fluidity (mg/sec)*1 | At high temp. & high hum. | At low temp. & low hum. | At high temp. & high hum. | At low temp. & low hum. | Difference in charging under different environments | Keeping property | Charging distribution | Charging distribution | Fogging of background | Unevennes of image density, carriage failure | Density keeping property | Internal adhesion of the machine | Image failure between lines (Hollow character) |
| Ex. | | | | | | | | | | | | | | |
| 1 | 880 (○) | −14 | −18 | −12 | −16 | ○ | ○ | ○ | ○ | ○ | ○ | ○ | ○ | ○ |
| 2 | 940 (○) | −13 | −16 | −12 | −14 | ○ | ○ | ○ | ○ | ○ | ○ | ○ | ○ | ○ |
| 3 | 910 (○) | −15 | −17 | −11 | −16 | ○ | ○ | ○ | ○ | ○ | ○ | ○ | ○ | ○ |
| 4 | 900 (○) | −17 | −21 | −14 | −19 | ○ | ○ | ○ | ○ | ○ | ○ | ○ | ○ | ○ |
| 5 | 860 (○) | −15 | −18 | −11 | −16 | ○ | ○ | ○ | ○ | ○ | ○ | ○ | ○ | ○ |
| 6 | 760 (○) | −11 | −16 | −9 | −14 | Δ | ○ | Δ | ○ | Δ | ○ | ○ | Δ | ○ |
| 7 | 780 (○) | −13 | −17 | −11 | −15 | ○ | ○ | ○ | ○ | ○ | ○ | ○ | ○ | ○ |
| 8 | 810 (○) | −18 | −24 | −14 | −19 | ○ | ○ | ○ | ○ | ○ | ○ | ○ | ○ | ○ |
| 9 | 710 (○) | −13 | −17 | −11 | −16 | ○ | ○ | ○ | ○ | Δ | ○ | ○ | ○ | ○ |
| C.E. | | | | | | | | | | | | | | |
| 1 | 600 (x) | −7 | −10 | −4 | −7 | Δ | Δ | x | x | x | ○ | Δ | x | ○ |
| 2 | 680 (x) | −6 | −11 | −5 | −9 | Δ | ○ | x | x | Δ | ○ | Δ | Δ | ○ |
| 3 | 670 (x) | −8 | −12 | −5 | −8 | Δ | Δ | Δ | Δ | x | x | Δ | ○ | x |
| 4 | 570 (x) | −2 | +1 | 0 | −1 | x | x | xx | x | xx | x | Δ | xx | x |
| 5 | 710 (○) | −8 | −13 | −5 | −9 | Δ | Δ | x | Δ | Δ | ○ | x | x | ○ |
| 6 | 890 (○) | −8 | −19 | −6 | −14 | x | Δ | x | x | ○ | ○ | x | Δ | ○ |
| 7 | 930 (○) | −9 | −18 | −6 | −17 | x | Δ | x | x | ○ | ○ | Δ | Δ | x |
| 8 | 580 (x) | −6 | −9 | −5 | −10 | Δ | Δ | Δ | Δ | x | x | Δ | Δ | ○ |
| 9 | 940 (○) | −9 | −24 | −5 | −20 | xx | Δ | x | x | ○ | Δ | ○ | Δ | ○ |
| 10 | 780 (○) | −8 | −15 | −4 | −9 | Δ | Δ | x | x | ○ | ○ | ○ | x | Δ |

C.E. = Comparative Example

Preparation of External Additive II-A 50 parts by weight of isobutyltrimethoxysilane were mixed with 100 parts of $TiO(OH)_2$ prepared by the procedure as described above, reacted while heating, then rinsed, filtrated, dried at 120° C. and deagglomerating soft agglomeration by means of pin mill to obtain a titanium compound, External additive II-A having average particle diameter of 30 nm, specific gravity of 3.1 and resistance of $5.8\times10^{10}$ Ω·cm.

Preparation of External Additive II-B

The similar procedures to those for External Additive II-A were carried out except that PH-adjustment and dispersion Preparation of External Additive II-E The $TiO(OH)_2$ prepared by the procedure as described above was rinsed, filtrated, calcined, and obtained a titanium oxide having particle diameter of 30 nm. And then, it was pulverized by means of a jet mill to obtain External Additive II-E having specific gravity of 3.9 and resistance of $6.0\times10^{6}$Ω·cm.

Preparation of External Additive II-F

External additive II-E was dispersed in methanol. 40 parts by weight of isobutyltrimethoxysilane were mixed to 100 parts by weight of External Additive II-E, subjected to a wet-pulverization by means of a sand grinder, and stirred to remove a solvent by means of a kneader, and then dried to obtain External Additive II-F having specific gravity of 3.9 and resistance of $3.0\times10^{9}\Omega\cdot$cm.

Preparation of External Additive II-G

The $TiO(OH)_2$ prepared by the procedure as described above was rinsed, filtrated, calcined, and obtained a titanium oxide having particle diameter of 30 nm. And then, it was dispersed in water again, after a wet-pulverization by means of a sand grinder. 40 parts by weight of isobutyltrimethoxysilane were mixed in the water, and stirred, dried, and then pulverized by means of a jet mill to obtain External Additive II-G having specific gravity of 3.9 and resistance of $4.2\times10^{9}\Omega\cdot$cm.

Preparation of Toner Grain II-1

Polyester resin: 92 parts by weight (terephthalic acid/bisphenol-A propyleneoxide adduct, Mw=11,000, Mn=3,300, Tg=67° C., softening point=97° C.) Phthalocyanine (C.I. Pigment Blue 15:3) pigment: 5 parts by weight Charging controlling agent: 3 parts by weight (Zn Salicylic Acid Complex Compound of Example (1))

The materials as described above were mixed together by means of a Henschel mixer, kneaded in a molten state by means of an extruder and pulverized by means of a jet mill after being cooled, and then classified by means of a screen classifier to obtain Cyan-Toner Grain II-1 having an average particle diameter of 9.0 $\mu$m.

Preparation of Toner Grain II-2

The similar procedures to those for Toner particle II-1 were repeated except that the colorant was replaced with 5 parts by weight of C.I. Pigment Red 57:1 to obtain Magenta Toner Grain II-2 having an average particle diameter of 9.1 $\mu$m.

Preparation of Toner Grain II-3

The similar procedures to those for Toner Grain II-1 were repeated except that the colorant was replaced with 5 parts by weight of C.I. Pigment Yellow 17 to obtain Yellow Toner Grain II-3 having an average particle diameter of 9.2 $\mu$m.

Preparation of Toner Grain II-4

The similar procedures to those for Toner Grain II-1 were repeated except that the colorant was replaced with 4 parts by weight of carbon black to obtain Black Toner Grain II-4 having an average particle diameter of 9.0 $\mu$m.

Preparation of Toner Grain II-5

Polyester resin: 92 parts by weight (terephthalic acid/glycerin/bisphenol-A propyleneoxide adduct, Mw=18,000, Mn=3,800, Tg=65° C., softening point=105° C.) Phthalocyanine (C.I. Pigment Blue 15:3) pigment: 5 parts by weight Charging controlling agent: 3 parts by weight (Zn Salicylic Acid Complex Compound of Example (3))

The materials as described above were mixed together by means of a Henschel mixer, kneaded in a molten state by means of an extruder, and pulverized by means of a jet mill after being cooled, and then classified by means of a screen classifier to obtain Cyan Toner Grain II-5 having an average particle diameter of 9.0 $\mu$m.

Preparation of Toner Grain II-6

The similar procedures to those for Toner Grain II-5 were repeated except that the colorant was replaced with 5 parts by weight of C.I. Pigment Red 122 to obtain Magenta Toner Grain II-7 having an average particle diameter of 9.0 $\mu$m.

Preparation of Toner Grain II-7

The similar procedures to those for Toner Grain II-5 were repeated except that the colorant was replaced with 5 parts by weight of C.I. Pigment Yellow 17 to obtain Yellow Toner Grain II-7 having an average particle diameter of 9.2 $\mu$m.

Preparation of Toner Grain II-8

The similar procedures to those for Toner Grain II-5 were repeated except that the colorant was replaced with 4 parts by weight of carbon black to obtain Black Toner Grain II-8 having an average particle diameter of 9.3 $\mu$m.

Image Forming Apparatus

Figure 2:
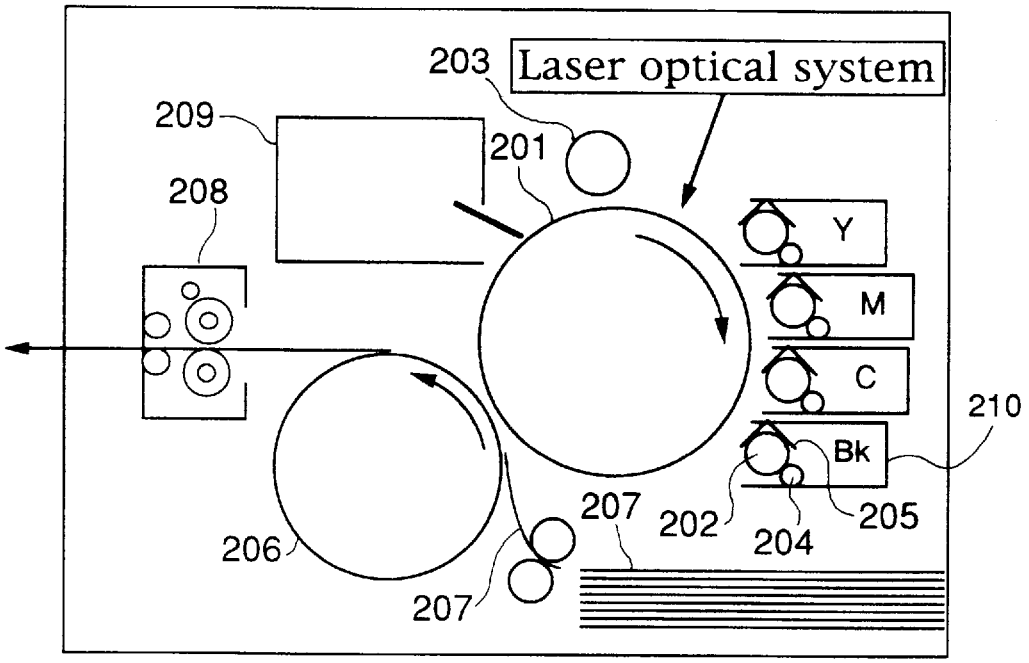
FIG. 2 is a block diagram of an image forming apparatus of a preferred embodiment applied to the method for forming an image using non-magnetic mono-component developer according to the present invention.

FIG. 2 shows the image forming apparatus used for an evaluation of image quality of non-magnetic mono-component developer. The developer-holding member 202 having four color developer comprising yellow, magenta, cyan and black is arranged with a gap of 150 $\mu$m between the latent image-holding member 201 and the developer-holding member 202. The latent image-holding member 201 was designed so that after the latent image-holding member 201 was charged by the roller charger 203, and electrostatic latent image was formed by an exposure to laser light, and said electrostatic latent image was developed by applying alternating voltage and direct voltage to said developer-holding member 203 and developer-supplying roller 204, and the charging/exposure/development processes of four color toner were repeated in four cycles. The formation of the layer of the developer was carried out by contacting the layer-forming blade of silicone rubber 205 directly with the developer-holding member 202 at a definite line pressure. The transferring of the toner was carried out by winding transfer paper 207 around the transfer drum 206 and superimposing a toner image on the latent image-holding member 201 on the transfer paper 207 with respect to each color. The fixing was carried out by a heat-fixing apparatus 208. Herein, the peripheral speed of the latent image-holding member 201 was 130 mm/s, and the peripheral speed of the developer-holding member 200 mm/s, and the cleaning of non-transferred toner on the latent image-holding member 201 was carried out by making use of blade-type cleaner 208.

EXAMPLE 10

1.0 part by weight of External Additive II-A and 0.8 parts by weight of silica fine particle, the surface of which being hydrophobic-treated with a dimethylsilicone oil, having BET specific surface area of 110 $m^2/g$ were mixed with 100 parts by weight of Toner Grains II-1 through II-4 by means of Henschel mixer, and screen-classified by means of air screen classifier having a mesh diameter of 45 $\mu$m to obtain Developers II-1 through II-4. The Developers II-1 through II-4 were put into the developing apparatuses of cyan, magenta, yellow and black of the image-forming apparatus showed in FIG. 2, and print tests of a total of 10,000 sheets of paper were carried out under two kinds of environments to evaluate changes after every 1,000 sheets of paper, that is, environment at high temperature of 28° C. and high humidity of 85% RH, and environment at low temperature of 10° C. and low humidity of 30% RH., to obtain continuously a high image quality without unevenness in image density and fogging, etc. The results were shown in Table 2.

EXAMPLE 11

The similar procedures to those for Example 10 were carried out except that External Additive II-A was replaced with External Additive II-D, to obtain Developers II-5 through II-8. An evaluation test for image quality was carried out for Developers II-5 through II-8 as described in Example 10, to obtain continuously the same high image quality as that of Example 10. The results were shown in Table 2.

EXAMPLE 12

1.2 parts by weight of External Additive II-B and 0.6 parts by weight of silica fine particle, the surface of which being hydrophobic-treated with a dimethyldichlorosilane, having BET specific surface area of 120 $m^2/g$ were mixed with 100 parts by weight of Toner Grains II-1 thorough II-4 by means of Henschel mixer, and screen-classified by means of air screen classifier having a mesh diameter of 45 $\mu$m to obtain Developers II-9 through II-12. An evaluation test for image quality was carried out for Developers II-9 through II-12 as described in Example 10, to obtain continuously the same high image quality as that of Example 10. The results were shown in Table 2.

EXAMPLE 13

1.3 parts by weight of External Additive II-C was mixed with 100 parts by weight of Toner Grains II-1 through II-4 by means of Henschel mixer, and screen-classified by means of air screen classifier having mesh of 45 $\mu$m to obtain Developers II-13 through II-16. An evaluation test for image quality was carried out for Developers II-13 through II-16 as described in Example 10, to obtain continuously the same high image quality as that of Example 10. The results were shown in Table 2.

EXAMPLE 14

1.0 part by weight of External Additive II-A and 0.9 parts by weight of silica fine particle, the surface of which being hydrophobic-treated with a dimethylsilicone oil, having BET specific surface area of 60 $m^2/g$ were mixed with 100 parts by weight of Toner Grains II-1 through II-4 by means of Henschel mixer, and screen-classified by means of air screen classifier having a mesh diameter of 45 $\mu$m to obtain Developers II-17 through II-20. An evaluation test for image quality was carried out for Developers II-17 through II-20 as described in Example 10, to obtain continuously the same high image quality without unevenness and fogging, etc., as that of Example 10. The results were shown in Table 2.

EXAMPLE 15

1.0 part by weight of External Additive II-B and 0.8 parts by weight of silica fine particle, the surface of which being hydrophobic-treated with a dimethylsilicone oil, having BET specific surface area of 90 $m^2/g$ were mixed with 100 parts by weight of Toner Grains II-5 through II-8 by means of Henschel mixer, and screen-classified by means of air screen classifier having a mesh diameter of 45 $\mu$m to obtain Developers II-21 through II-24. An evaluation test for image quality was carried out for Developers II-21 through II-24 as described in Example 10, to obtain continuously the same high image quality without unevenness and fogging, etc., as that of Example 10. The results were shown in Table 2.

EXAMPLE 16

The similar procedures to those for Example 15 were carried out except that External Additive II-B was replaced with External additive II-C to obtain Developers II-25 through II-28. An evaluation test for image quality was carried out for Developers II-25 through II-28 as described in Example 10, to obtain continuously the same high image quality without unevenness, fogging, etc., as that of Example 10. The results were shown in Table 2.

EXAMPLE 17

1.0 part by weight of External Additive II-D and 0.7 parts by weight of silica fine particle, the surface of which being hydrophobic-treated with a hexamethylene disilazane, having BET specific surface area of 70 $m^2/g$ were mixed with 100 parts by weight of Toner Grains II-5 through II-8 by means of Henschel mixer, and screen-classified by means of air screen classifier having a mesh diameter of 45 $\mu$m to obtain Developers II-29 through II-32. An evaluation test for image quality was carried out for Developers II-29 through II-32 as described in Example 10, to obtain continuously the same high image quality without unevenness, fogging, etc., as that of Example 10. The results were shown in Table 2.

EXAMPLE 18

1.0 part by weight of External Additive II-A was mixed with 100 parts by weight of Toner Grains II-5 through II-8 by means of Henschel mixer, and screen-classified by means of air screen classifier having a mesh diameter of 45 $\mu$m to obtain Developers II-33 through II-36. An evaluation test for image quality was carried out for Developers II-33 through II-36 as described in Example 10, to obtain continuously the same high image quality as that of Example 10. The results were shown in Table 2.

Comparative Example 11

The similar procedures to those for Example 10 were carried out except that External Additive II-A was replaced with External Additive II-E to obtain Developers II-37 through II-40. An evaluation test for image quality was carried out for Developers II-37 through II-40 as described in Example 10. As the result, a numerous fogging was observed in the image from the beginning and the internal adhesion of the apparatus occurred with violence because of flying of the toner. The results were shown in Table 2.

Comparative Example 12

The similar procedures to those for Example 10 were carried out except that External Additive II-A was replaced with External Additive II-F to obtain Developers II-41 through II-44. An evaluation test for image quality was carried out for Developers II-41 through II-44 as described in Example 10. As the result, the image density is decreased after about 1,500th copying and the fogging and flying of the toner became worse. The results were shown in Table 2.

Comparative Example 13

The similar procedures to those for Example 17 were carried out except that External Additive II-D was replaced with External Additive II-G to obtain Developers II-45 through II-48. An evaluation test for image quality was carried out for Developers II-45 through II-48 as described in Example 10. As the result, the image density is decreased after about 2,000th copying and the fogging and flying of the toner became worse. The results were shown in Table 2.

Comparative Example 14

The similar procedures to those for Example 18 were carried out except that External Additive II-A was replaced with External Additive II-F to obtained Developers II-49 through II-52. An evaluation test for image quality was carried out for Developers II-49 through II-52 as described in Example 10. As the result, a numerous fogging was observed in the image from the beginning and the internal adhesion of the apparatus occurred with violence because of flying of the toner. The results were shown in Table 2.

Comparative Example 15

1.0 part by weight of silica fine particle, the surface of which being hydrophobic-treated with a dimethylsilicone oil, having BET specific surface area of 110 $m^2/g$ was mixed with 100 parts by weight of Toner Grains II-1 through II-4 by means of Henschel mixer, and screen-classified by means of air screen classifier having a mesh diameter of 45 $\mu$m to obtain Developers II-53 through II-56. An evaluation test for image quality was carried out for Developers II-53 through II-56 as described in Example 10. As the results, a numerous fogging was observed in the image from the beginning, and lines occurred on the developing roll after about 500th copying and the image density dependent on environment varied significantly. The results were shown in Table 2.

Comparative Example 16

1.0 part by weight of silica fine particle, the surface of which being hydrophobic-treated with a dimethyldichlorosilane, having BET specific surface area of 120 $m^2/g$ was mixed with 100 parts by weight of Toner Grains II-5 through II-8 by means of Henschel mixer, and screen-classified by means of air screen classifier having a mesh diameter of 45 $\mu$m to obtain Developers II-57 through II-60. An evaluation test for image quality was carried out for Developers II-57 through II-60 as described in Example 10. As the results, a numerous fogging was observed in the image from the beginning, and lines occurred on the developing roll after about 500th copying and the image density dependent on environment varied significantly. The results were shown in Table 2.

Evaluation Method

Initial Density

In the measurement of density by means of a densitometer X-Rite 404A, manufactured by X-Rite Co. Ltd,; ×<1.1, 1.1 ≦Δ<1.4, 1.4 ≦○.

Density-keeping Property

The density after copying of 1000 sheets of paper was evaluated by the same method as described above.

Initial Fogging

The background of the image was visually observed by 50× magnifier for sensory evaluation; ○ - - - nil, Δ - - - several, × - - - fairly.

Fogging-keeping Property

The fogging after copying of 1000 sheets of paper was evaluated by the same method as described above.

Difference in the Density Under Different Environments

A difference in the densities between under the environment at high temperature of 28° C. and 85% RH and under the environment at low temperature of 10° C. and 30% RH;

○<0.2, 0.2 ≦Δ<0.4, 0.4 ≦×.

Line-in the Image, Flying of the Toner, Filming

The each state was evaluated by visual examination; ○ - - - nil, Δ - - - several, × - - - fairly.

TABLE 2

| | Initial density | Density-keeping property | Initial fogging | Fog-keeping property | Difference in density under different environments | Line in image | Flying of toner | Filming |
|---|---|---|---|---|---|---|---|---|
| Example 10 | ○ | ○ | ○ | ○ | ○ | ○ | ○ | ○ |
| Example 11 | ○ | ○ | ○ | ○ | ○ | ○ | ○ | ○ |
| Example 12 | ○ | ○ | ○ | ○ | Δ | ○ | ○ | ○ |
| Example 13 | ○ | Δ | ○ | ○ | ○ | ○ | Δ | ○ |
| Example 14 | ○ | ○ | ○ | ○ | ○ | ○ | ○ | ○ |
| Example 15 | ○ | ○ | ○ | ○ | ○ | ○ | ○ | ○ |
| Example 16 | ○ | ○ | ○ | ○ | ○ | ○ | ○ | ○ |
| Example 17 | ○ | ○ | ○ | ○ | Δ | ○ | ○ | ○ |
| Example 18 | ○ | Δ | ○ | ○ | ○ | ○ | Δ | ○ |
| Comparative Example 11 | ○ | — | x | — | — | — | x | — |
| Comparative Example 12 | ○ | x | ○ | x | Δ | x | x | Δ |
| Comparative Example 13 | ○ | x | ○ | x | Δ | x | x | Δ |
| Comparative Example 14 | Δ | — | x | — | — | — | x | — |
| Comparative Example 15 | Δ | x | x | x | x | x | x | ○ |
| Comparative Example 16 | Δ | x | x | x | x | x | x | ○ |

Preparation of External Additive III-A 40 parts by weight of isobutyltrimethoxysilane were mixed with 100 parts of $TiO(OH)_2$ prepared by the procedure as described above, reacted while heating, then rinsed, filtrated, dried at 120° C. and deagglomerating soft agglomeration by means of pin mill to obtain a titanium compound, External Additive III-A, having average particle diameter of 25 nm, and specific gravity of 3.1.

Preparation of External Additive III-B

The similar procedures to those for External Additive III-A were carried out except that PH-adjustment and dispersion controlling to control the particle diameter were changed and 40 parts by weight of isobutyltrimethoxysilane were mixed, to obtain a titanium compound, External Additive III-B, having average particle diameter of 50 nm and specific gravity of 3.1.

Preparation of External Additive III-C 25 parts by weight of dimethylsilicone oil(KF96, made from SHINETSU KAGAKUKOHGYOH Co. LTD.,) were mixed with 100 parts of $TiO(OH)_2$ prepared by the procedure as described above, reacted while heating. And then, the same procedures to those for External Additive III-A were carried out to obtain titanium compound, External Additive III-C, having average particle diameter of 35 nm and specific gravity of 3.3.

Preparation of External Additive III-D $TiO(OH)_2$ prepared by the procedure as described above was rinsed , filtrated, calcined to obtain a titanium oxide having average particlediameter of 25 nm. Then, it was pulverized by means of a jet mill to obtain External Additive III-D having average particle diameter of 25 nm and specific gravity of 4.0.

Preparation of Y Toner Grain

Binding Resin 95 parts (terephthalic acid/bisphenol-A propylene oxide adduct, Mw=3300, Tg=67° C., softening point=97° C.): Yellow pigment (C.I. Pigment Yellow 97): 5 parts The materials were mixed together by means of Henschel mixer, kneaded in a molten state by an extruder, and pulverizedafter by jet mill after being cooled, and then classified by means of screen classifier to obtain Yellow Grain III-1 having average particle diameter of 9.0 μm.

Preparation of M Toner Grain

The similar procedures to those for Toner Grain III-1 were repeated except that the colorant was replaced with 5 parts by weight of C.I. Pigment Red 57:1, to obtain Magenta Toner Grain III-2 having average particle diameter of 9.1 μm.

Preparation of C Toner Grain

The similar procedures to those for Toner Grain III-1 were repeated except that the colorant was replaced with 5 parts by weight of C.I. Pigment Blue 15:3, to obtain Cyan Toner Grain III-3 having average particle diameter of 8.9 μm.

Preparation of K Toner Grain

The similar procedures to those for Toner Grain III-1 were repeated except that the colorant was replaced with 5 parts by weight of carbon black, to obtain Black Toner particle III-4 having average particle diameter of 9.0 μm.

EXAMPLE 19

100 parts by weight of each Toner Grain III-1 through III-4, and 1.0 part by weight of External Additive III-A, and 0.5 parts by weight of hydrophobic silica having BET specific surface area of 60 $m^2/g$ were mixed together by means of Henschel mixer to obtain four color toner.

EXAMPLE 20

The similar procedures to those for Example 19 were carried out except that External Additive III-A was replaced with External Additive III-B to obtain four color toner.

EXAMPLE 21

The similar procedures to those for Example 19 were carried out except that External Additive III- A was replaced with External Additive III-C to obtain four color toner.

Comparative Example 17

The similar procedures to those for Example 19 were carried out except that External Additive III-A was replaced with External Additive III-D to obtain four color toner.

EXAMPLE 22

The similar procedures to those for Example 19 were carried out except that the BET specific surface area was changed to 15 $m^2/g$ to obtain four color toner.

EXAMPLE 23

The similar procedures to those for Example 19 were carried out except that the BET specific surface area was changed to 150 $m^2/g$ to obtain four color toner.

An Image Forming Apparatus

Figure 3:
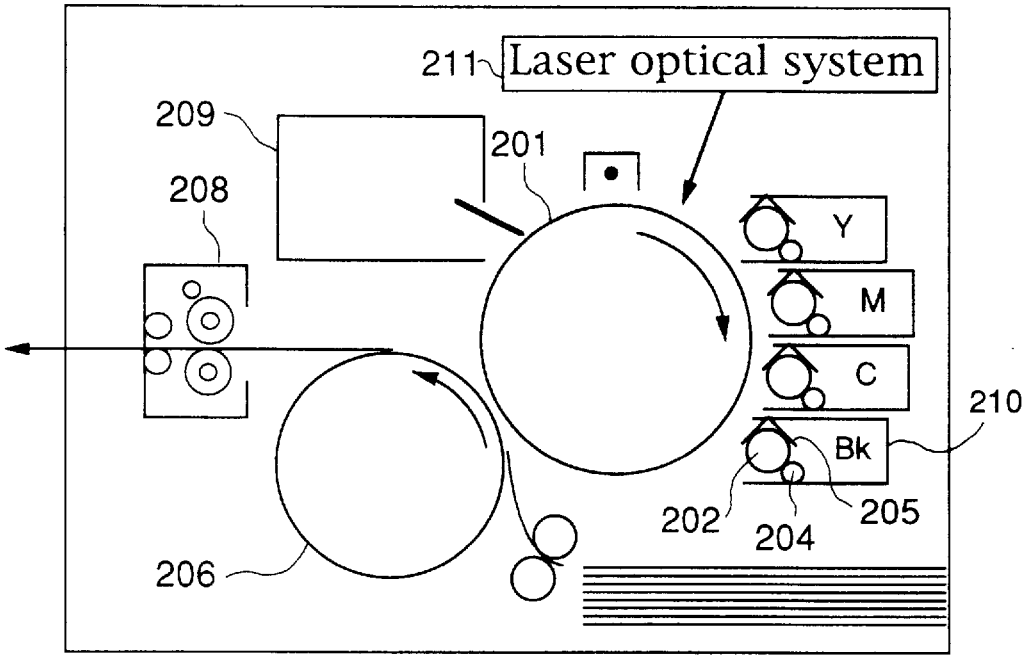
FIG. 3 is a variation of FIG. 2 and a block diagram of preferred image forming apparatus applied to the method for forming a multicolor image according to another aspect of the present invention.

FIG. 3 shows the image forming apparatus used for evaluation of the image quality in the present invention. Four-developing apparatus 210 having toners of yellow, magenta, cyan and black were arranged around the latent image-holding member 201 (photosensitive material) with a definite space between the developer-holding member 202 and the latent image-holding member 201. The latent image-holding member 201 was designed so that an electrostatic latent image could be formed by exposure to the laser light after being charged by Corotron charger 211, and the alternating voltage and direct voltage were applied to the developer-holding member 202 and developer-supplying roller 204 to develop the latent image. The charging/exposure/development of four color toner was carried out in four cycle. The formation of the layer of the toner on the developer-holding member 202 was carried out by directly contacting the layer-forming blade of silicone rubber with the developer-holding member 202 at a constant line pressure. The developer-holding member 202 was made from SUS. The peripheral speed of the latent image-holding member (photosensitive material) 201 was 100 mm/s, and that of the developer-holding member 202 was 150 mm/s. The toner was transferred by means of the transfer roller 206, and collectively transferred after superimposing four color toner on the photosensitive material, and then fixed through the fixing apparatus 208. The cleaning was carried out by the blade-type cleaner 209 only at the time when the collective-transfer was finished.

Density-keeping Property, Difference in Density Under Different Environments, Fogging-keeping Property, and Filming are evaluated by the methods as described previously. Unevenness of density is the difference in density in solid images;

$$\circ<0.2,\ 0.2 \leqq \Delta<0.4,\ 0.4 \leqq \times.$$

Transfer Efficiency: (weight of the toner image on the transfer paper)/(weight of the toner image on the photosensitive material) ×100;

$$\times<89\%,\ 80\% \leqq \Delta<90\%,\ 90\% \leqq \circ.$$

Table 3 shows that the density-keeping property, the difference in density under different environment, and fog-keeping property are poor in Comparative Example 17 using titanium compound prepared by calicination.

TABLE 3

| | Density-Keeping Property | Difference In Desnsity Under Different Environment | Unevenness Of Density | Fog-Keeping Property | Transfer Efficiency | Filming |
|---|---|---|---|---|---|---|
| Example 19 | ○ | ○ | ○ | ○ | ○ | ○ |
| Example 20 | ○ | ○ | ○ | ○ | ○ | ○ |
| Example 21 | ○ | ○ | ○ | ○ | ○ | ○ |

TABLE 3-continued

| | Density-Keeping Property | Difference In Desnsity Under Different Environment | Unevenness Of Density | Fog-Keeping Property | Transfer Efficiency | Filming |
|---|---|---|---|---|---|---|
| Comparative Example 17 | x | x | Δ | x | ○ | Δ |
| Example 22 | ○ | ○ | Δ | Δ | ○ | ○ |
| Example 23 | ○ | ○ | ○ | Δ | Δ | ○ |

What is claimed is:

1. A mono-component developer comprising: toner particles comprising a binding resin and a colorant, and an additive, wherein said additive contains a titanium compound prepared by a reaction of $TiO(OH)_2$ with a silane compound or by a reaction of $TiO(OH)_2$ with a silicone oil.

2. A mono-component developer according to claim 1, wherein said toner particles further comprise a salicylic acid metal complex compound as a charge controlling agent.

3. A mono-component developer according to claim 1, wherein said titanium compound is prepared by a reaction of $TiO(OH)_2$ with a silicone oil and said titanium compound has a specific gravity of between 2.8 and 3.6.

4. A mono-component developer according to claim 3, wherein said $TiO(OH)_2$ is prepared through a wet process.

5. A mono-component developer according to claim 2, wherein said binding resin contains a polyester resin.

6. A mono-component developer according to claim 5, wherein said polyester resin has a softening point in the range of 90° C. to 120° C. and a glass transition point of between 60° C. and 70° C.

7. A mono-component developer according to claim 2, wherein said additive further comprises hydrophobic silica fine particles.

8. A mono-component developer according to claim 2, wherein said toner particles are non-magnetic particles.

9. A mono-component developer according to claim 3, wherein said toner particles are non-magnetic particles.

10. A mono-component developer according to claim 3, wherein the amount of said titanium compound ranges from 0.1 to 5.0% by weight based on the developer.

11. A mono-component developer according to claim 1, wherein said titanium compound has an average particle diameter of between 10 and 70 nm.

12. A method for forming an image comprising the step of: forming a latent image on a latent image-holding member, developing said latent image on a developer-holding member by making use of a developer, and transferring a toner image on a transfer sheet, wherein said developer comprises toner particles comprising a binding resin, a colorant and a charge controlling agent, and an additive, said charge controlling agent being a salicylic acid metal complex compound, and said additive contains a titanium compound prepared through the reaction of $TiO(OH)_2$ with a silane compound or through the reaction of $TiO(OH)_2$ with a silicone oil.

13. A method for forming an image according to claim 12, wherein the latent image is developed in the developing step without any contact between the developer-holding member and the latent image-holding member occurring.

14. A method for forming an image according to claim 12, wherein said developer-holding member is pressed by a toner-supplying roll to form a layer of the developer on said developer-holding member.

15. A method for forming an image according to claim 12, wherein transfer is carried out in said transfer step while is put into contact with the latent image-holding member the charging material through the said transfer sheet or while being pressed onto the said latent image-holding member.

16. A method for forming multicolored images comprising a step for developing repeatedly a latent image formed on a latent holding member by making use of plural developers, and a step for transferring collectively multicolored toner images formed by superimposition on said latent image-holding member or an intermediate transfer sheet, wherein said developer comprises toner particles containing a binding resin and a colorant and an additive, and said additive contains a titanium compound prepared through the reaction of $TiO(OH)_2$ with a silane compound or through the reaction of $TiO(OH)_2$ with a silicone oil and a silica having a BET specific surface area of between 20 to 100 $m^2/g$.

17. A method for forming multicolored images according to claim 16, wherein said developer is a non-magnetic mono-component developer.

* * * * *